US008904690B1

(12) United States Patent
Cantrell

(10) Patent No.: US 8,904,690 B1
(45) Date of Patent: Dec. 9, 2014

(54) HANDHELD FIREARMS WITH INDEXED MAGAZINE AND COMPACT FIRING MECHANISM

(71) Applicant: Daniel Cantrell, Yulee, FL (US)

(72) Inventor: Daniel Cantrell, Yulee, FL (US)

( * ) Notice: Subject to any disclaimer, the term of this patent is extended or adjusted under 35 U.S.C. 154(b) by 0 days.

(21) Appl. No.: 14/312,268

(22) Filed: Jun. 23, 2014

Related U.S. Application Data

(63) Continuation-in-part of application No. 13/843,284, filed on Mar. 15, 2013, now Pat. No. 8,756,843.

(60) Provisional application No. 61/694,854, filed on Jun. 21, 2012, provisional application No. 61/645,671, filed on May 11, 2012.

(51) Int. Cl.
*F41A 9/61* (2006.01)
*F41A 19/13* (2006.01)
*F41A 19/14* (2006.01)

(52) U.S. Cl.
CPC ..... *F41A 19/13* (2013.01); *F41A 19/14* (2013.01)
USPC ..... 42/6; 42/49.01

(58) Field of Classification Search
CPC ..... F41A 9/65; F41A 9/70; F41A 9/69; F41A 19/13; F41A 19/14
USPC ..... 42/49.01–49.1, 17–18, 21–22, 24, 29, 42/33, 35, 37, 39, 6
See application file for complete search history.

(56) References Cited

U.S. PATENT DOCUMENTS

| | | | | | |
|---|---|---|---|---|---|
| 3,483,648 | A * | 12/1969 | Speckhart | 42/10 |
| 3,706,151 | A * | 12/1972 | McNeill | 42/106 |
| 4,159,670 | A * | 7/1979 | Turner | 89/155 |
| 4,267,764 | A * | 5/1981 | Yaniger | 89/25 |
| 5,020,258 | A * | 6/1991 | Rick | 42/65 |
| 5,081,778 | A * | 1/1992 | Switzer | 42/50 |
| 5,092,068 | A * | 3/1992 | Rick | 42/64 |
| 5,682,699 | A * | 11/1997 | Gentry | 42/23 |
| 7,047,686 | B2 * | 5/2006 | Zimmermann | 42/75.1 |
| 7,305,786 | B2 * | 12/2007 | McGarry | 42/1.05 |
| 7,318,294 | B2 * | 1/2008 | Zimmermann | 42/7 |
| 7,360,331 | B2 * | 4/2008 | McGarry | 42/70.02 |
| 7,886,470 | B1 * | 2/2011 | Doiron | 42/69.02 |
| 8,037,805 | B1 * | 10/2011 | Neroni | 89/196 |
| 8,485,083 | B1 * | 7/2013 | Care | 89/33.02 |
| 8,756,843 | B1 * | 6/2014 | Cantrell | 42/6 |
| 2005/0229457 | A1 * | 10/2005 | McGarry | 42/1.01 |
| 2005/0257413 | A1 * | 11/2005 | Zimmermann | 42/75.1 |
| 2006/0272192 | A1 * | 12/2006 | Zimmermann | 42/7 |
| 2008/0148618 | A1 * | 6/2008 | McGarry | 42/70.08 |
| 2012/0144712 | A1 * | 6/2012 | Rostocil | 42/16 |
| 2013/0125441 | A1 * | 5/2013 | Westwood et al. | 42/70.05 |

* cited by examiner

*Primary Examiner* — Michael David
(74) *Attorney, Agent, or Firm* — Mark Young, P.A.

(57) ABSTRACT

New handgun configurations are enabled by a multiple cartridge magazine that includes the firing chamber for each cartridge. A hammer with a pivot pin below and between the leading and trailing edges of a chamber strikes the primer at an acute angle. A sliding trigger mechanism with cupped ball bearings in pockets facilitate sliding motion.

20 Claims, 37 Drawing Sheets

HANDHELD FIREARMS WITH INDEXED MAGAZINE AND COMPACT FIRING MECHANISM

RELATED APPLICATIONS

This application is a continuation in part and claims the benefit of priority of U.S. Nonprovisional application Ser. No. 13/843,284 filed Mar. 15, 2013, which is a nonprovisional and claims the benefit of priority of U.S. Provisional Application 61/694,854 filed Jul. 21, 2012, and U.S. Provisional Application 61/645,671 filed May 11, 2012, the entire contents of which are incorporated herein by this reference and made a part hereof.

FIELD OF THE INVENTION

This invention relates generally to handheld firearms and more particularly to compact light weight handheld firearms with an indexed magazine and compact firing mechanism that enable various compact configurations, including but not limited to configurations that reduce torque from recoil.

BACKGROUND

Shortcomings with conventional handguns are numerous. As an example, many handguns contain extremely complex firing mechanism with several interconnected parts that are conducive to failure. Housing such firing mechanisms requires considerable space and limits the location of other components.

Concomitantly, conventional handguns that use a magazine contain extremely complex mechanisms to move a cartridge from the magazine to a firing chamber. These mechanisms also contain several interconnected parts that are conducive to failure. Additionally, housing such mechanisms requires additional space and further limits the location of other components. Moreover, the firing chamber cannot be changed in such handguns.

As an example of the limitation regarding location of other components, conventional handguns locate the barrel and firing chamber considerably above the handgrip. In this conventional configuration, the backward momentum of recoil typically causes the shooter's wrist and/or arm to bend with the gun barrel pivoting upwards. It would be preferable if a handgun transmitted recoil, not above the shooter's hand, but rather directly through a shooter's hand and forearm. Such a configuration would reduce or eliminate the unintended pivoting, which would reduce stress and allow a shooter to stay on target.

The invention is directed to overcoming one or more of the problems and solving one or more of the needs as set forth above.

SUMMARY OF THE INVENTION

The purpose of this invention is to provide a very compact, lightweight, simple hand-held firearm wherein the bulk of the mass of the firearm is held within the shooters hand. It is also a purpose of this invention to make this handheld firearm a multi-shot firearm with an easily loaded magazine and the capability of changing cartridge calibers by merely changing the magazine and the barrel. It is a further purpose of this invention to provide a compact handheld firearm wherein the centerline of recoil is near or at the center of the palm of the shooters hand and along the centerline of the shooters arm, thus eliminating the undesirable "barrel flip" associated with conventional handheld firearms where the centerline of recoil is above the shooters hand.

To solve one or more of the problems set forth above, an exemplary handgun according to principles of the invention includes a magazine. The magazine has a prismatic housing with a plurality of aligned spaced firing chambers, each firing chamber being shaped and sized to hold a cartridge for firing and having a shape and size that is compatible with cartridges matching the barrel of the firearm. The magazine has a top, a bottom, a front and a back, and an outer cam side and a second side. A cam track is provided on the outer cam side of the magazine between the magazine front and the magazine back. The cam track includes a three dimensional waveform channel extending from about the magazine bottom to about the magazine top and includes a waveform cycle for each firing chamber. Each cycle includes a track segment with a bend that changes direction from the first edge to the second edge of the magazine. Each cycle has a wavelength corresponding to the index distance between its associated firing chamber in the magazine. The cam track may, by way of example, define a zigzag, straight, serpentine, sinusoidal, cycloid and triangular path of travel. The gun includes a stock (i.e., handle) with a bottom, top, and a passage extending from the bottom to the top. The passage is shaped and sized to receive the magazine and allow the magazine to progress linearly through the passage. The passage includes a front surface, a rear surface, a first side surface and a second side surface, with a barrel opening in the front surface between the top and bottom of the stock. A barrel through which a bullet of a cartridge fired from one of the firing chambers may travel extends from the barrel opening in the front surface of the passage. A trigger includes a finger actuatable lever, the trigger being movable from an at rest position to a firing position. A firing pin strikes the cartridge for firing when the firing chamber containing the cartridge is aligned with the barrel at the firing position and the trigger is moved to the firing position. A cam follower rides in the cam track. The cam follower may comprise a pin, protrusion or roller sized to ride in the cam track. The cam follower is operably coupled to (i.e., functionally controlled by) the trigger. The cam follower urges the magazine towards the top of the stock (or toward the bottom of the stock if so configured) when the trigger is moved to the firing position. The cam follower urges the firing chamber containing the cartridge to be fired into alignment with the barrel at the barrel opening when the trigger is moved to the firing position. The cam track on the outer cam side of the magazine may include a step between each waveform cycle. The step impedes backward motion of the cam follower.

Each waveform cycle may include a dwell segment. In such embodiments, the cam follower does not move the magazine when the cam follower is riding through the dwell segment.

In a double barrel embodiment, the firearm may include two independently operated parallel magazines.

A cam follower arm operably coupled to the trigger is biased to urge the cam follower towards the cam track. The cam follower is attached at a terminus of the cam follower arm.

The cam follower arm may include a pivoting joint and a spring such as a torsion spring or a leaf spring biased to urge the cam follower towards the cam track and a spring biased to urge the cam follower arm to pivot towards the cam track thereby urging the cam follower towards the cam track.

An extractor may be provided for each firing chamber. The extractor includes a plurality of C-shaped grippers, one gripper per firing chamber. The grippers grip the rim of each cartridge in the firing chambers. The grippers are movable from a first position abutting the magazine to a position away from the magazine to eject each spent case.

A firing anvil with a front side and an opposite back side is attached to the firing pin. The back side of the firing anvil may have an inclined plane striking surface. A striking lug is aligned with the inclined plane striking surface. The striking lug, which includes a wedge shaped leading edge, moves from a position apart from the striking surface into collision with the striking surface with the wedge shaped leading edge colliding against the inclined plane striking surface and thereby driving the firing pin into the cartridge aligned with the barrel at the firing position. The striking lug (or hammer) is actuated by the trigger. Movement of the trigger to the firing position causes the wedge shaped leading edge to collide against the inclined plane striking surface. A sear disposed between the trigger and striking lug holds the striking lug until the trigger reaches the firing position, upon which the sear releases the striking lug causing the wedge shaped leading edge to collide against the inclined plane striking surface.

Optionally, the trigger includes an articulating trigger pull with a trigger slide and a trigger pull connected to the trigger slide by a pivot pin. The trigger pull articulates about an axis perpendicular to a longitudinal axis of the trigger slide, which facilitates pulling the trigger.

In some exemplary embodiments, the trigger is below the top of the stock and above the barrel.

To provide a compact design, in one exemplary embodiment, a firearm according to principles of the invention includes a hammer that pivots from a pivot pin located below the firing chamber between the leading edge and trailing edge of the firing chamber. The hammer includes a body and an element (e.g., firing pin) that strikes a primer. The hammer body pivots less than 180 degrees. The firing pin strikes the primer of a cartridge contained in the chamber. The struck primer ignites a propellant. Combustion gasses from the propellant propel a projectile of the cartridge from the chamber and through the barrel. In a particular embodiment, the hammer firing pin strikes the primer at an acute angle ($\theta$). The acute angle is measured between the longitudinal axis of the chamber and the longitudinal axis of the firing pin (or an axis normal to the striking surface of the firing pin). The acute angle is 30 to 75 degrees, preferably 40 to 60 degrees and more preferably about 45 degrees.

The hammer body defines a moment arm (m) measured from the center of the pivot pin to the striking surface of the firing pin. The moment arm is greater than the diameter of firing chamber, and preferably greater than 125 percent of the firing chamber, and more preferably greater than 150 percent of the diameter of the firing chamber. Such a moment arm generates sufficient torque for reliable firing, even if the range of pivoting motion of the hammer body is appreciably less than 180 degrees.

In another embodiment the exemplary firearm includes a trigger slide with a pocket (i.e., at least one pocket) cupping a ball bearing (i.e., cupping a ball bearing in each pocket, to facilitate smooth sliding motion of the trigger. In such an embodiment the slide and bearing also stabilize the trigger.

BRIEF DESCRIPTION OF THE DRAWINGS

The foregoing and other aspects, objects, features and advantages of the invention will become better understood with reference to the following description, appended claims, and accompanying drawings, where:

FIG. 18 shows the left side of a gun in an "at rest" position.

Those skilled in the art will appreciate that the Figures are not intended to be drawn to any particular scale; nor are the Figures intended to illustrate every embodiment of the invention. The invention is not limited to the exemplary embodiments depicted in the Figures or the specific components, configurations, shapes, relative sizes, ornamental aspects or proportions as shown in the figures.

DETAILED DESCRIPTION

Figure 1:
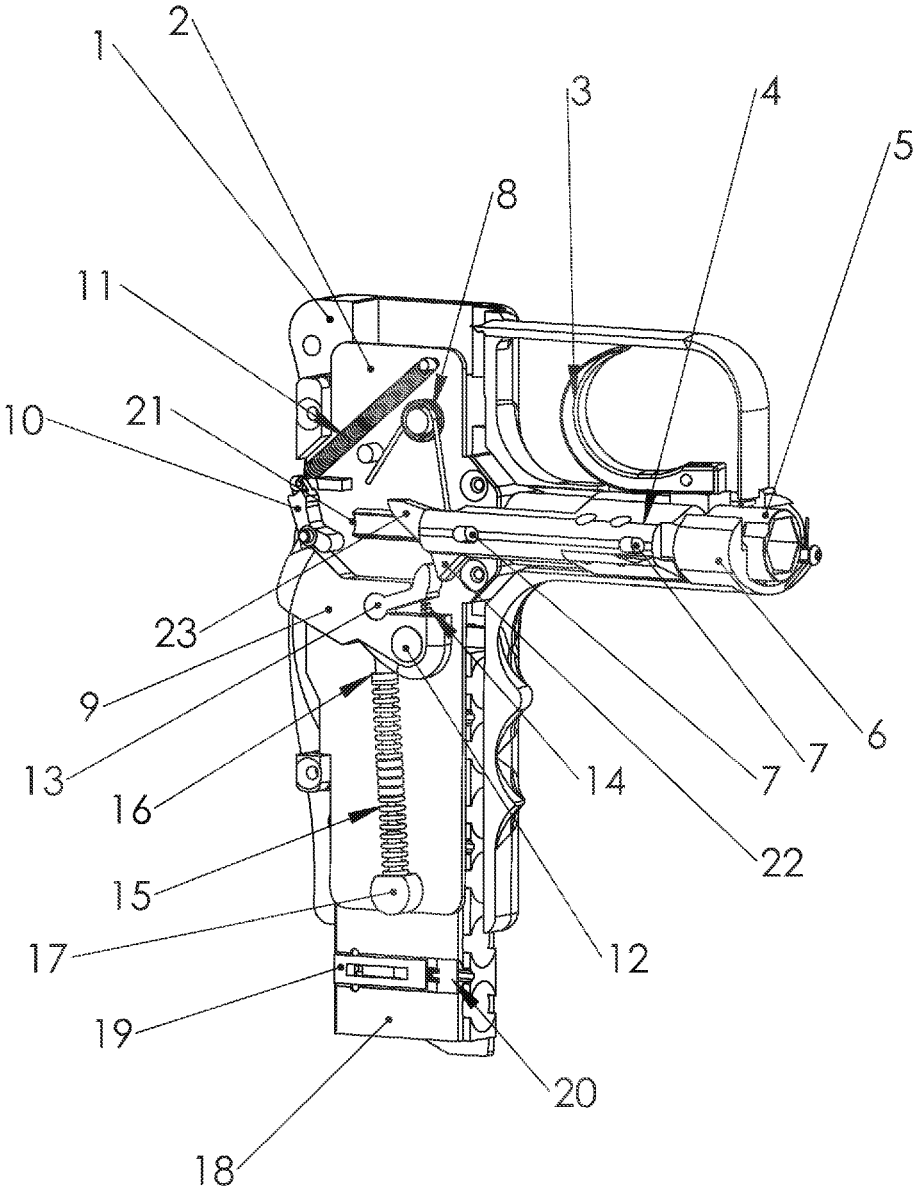
FIG. 1 is a schematic drawing that illustrates a perspective view of the right side of a completely assembled handgun according to one embodiment of the invention.

Referring to FIG. 1 the right side of an embodiment of a firearm according to principles of the invention is shown with particular emphasis on the firing mechanism of this embodiment. The left half 1 of an outer housing which encases the handgun and acts as a handle grip. A corresponding right half of this housing may be secured to the left half by screws or any suitable fasteners. An inner frame 2 supports the majority of the working parts of the gun. This inner frame may be a single piece or be made up of a plurality (e.g., two) parts joined together by screws or any other suitable fasteners. A trigger finger lever 3 is rotatably attached to a trigger slide 4. Trigger slide 4 may roll on a plurality of ball bearings 7 which run in curved tracks 21 which are integral with inner frame 2. A gun barrel 5 of suitable caliber with standard rifling and similar features as those currently used on standard revolver gun barrels is provided. A rotatably mounted stop 6 positions the forward stroke of trigger slide 4 in its rest position and then allows trigger slide 4 to advance forward to a magazine eject position when lever 6 is rotated downward. A torsion spring 8 mounted on an arbor on inner frame 2 engages trigger slide 4 to urge trigger slide 4 forward as the trigger is released by the shooter. A swinging hammer 9 pivots about a pivot pin 12 which is removably mounted on inner frame 2. A hammer relief lever 10 is journaled on pivot stud 31 to pivot in inner frame 2 and engage hammer 9 to retract it, after firing, to move the firing pin away from a fired cartridge and to clear the magazine channel to allow free movement of the magazine. A protrusion 23 on trigger slide 4 engages relief lever 10 when trigger slide 4 is drawn back into its firing position. An extension spring 11 is attached at one end to lever 10 and at the opposite end to inner frame 2. Spring 11 actuates hammer relief lever 10 and forces hammer 9 into a neutral position when trigger slide 4 is not in a firing position. A sear 13 is rotatably mounted in hammer 9 and engages with protrusion 22 attached to trigger slide 4. A compression spring 14 mounted between hammer 9 and sear 13 urges sear 13 in its upward position thereby engaging it with protrusion 22. A compression hammer spring 15 is mounted around spring mandrel 16 and captivated on its lower end by mandrel stop 17. Mandrel stop 17 is rotatably mounted in inner frame 2. Hammer spring mandrel 16 is engaged in its upper end in a pocket in hammer 9. The expanding force of spring 15 will rotate hammer 9 about pivot pin 12 thus causing it to drive firing pin 30 into a cartridge primer cap and fire a cartridge. A rectangular magazine 18 has a plurality of round chambers 42 bored lengthwise through it to house cartridges. Chambers 42 also act as the cartridge firing chambers much as the cylinder of a revolver. Leaf spring type ejectors 19 engage ejector grooves in standard cartridges to remove them from the magazine. Ejectors 19 are slidably mounted in magazine 18. Finger tabs 20 rotatably attached to ejectors 19 and may be rotated outward by the operator's finger to give better leverage for sliding ejectors 19 rearward to eject cartridges.

Figure 2:
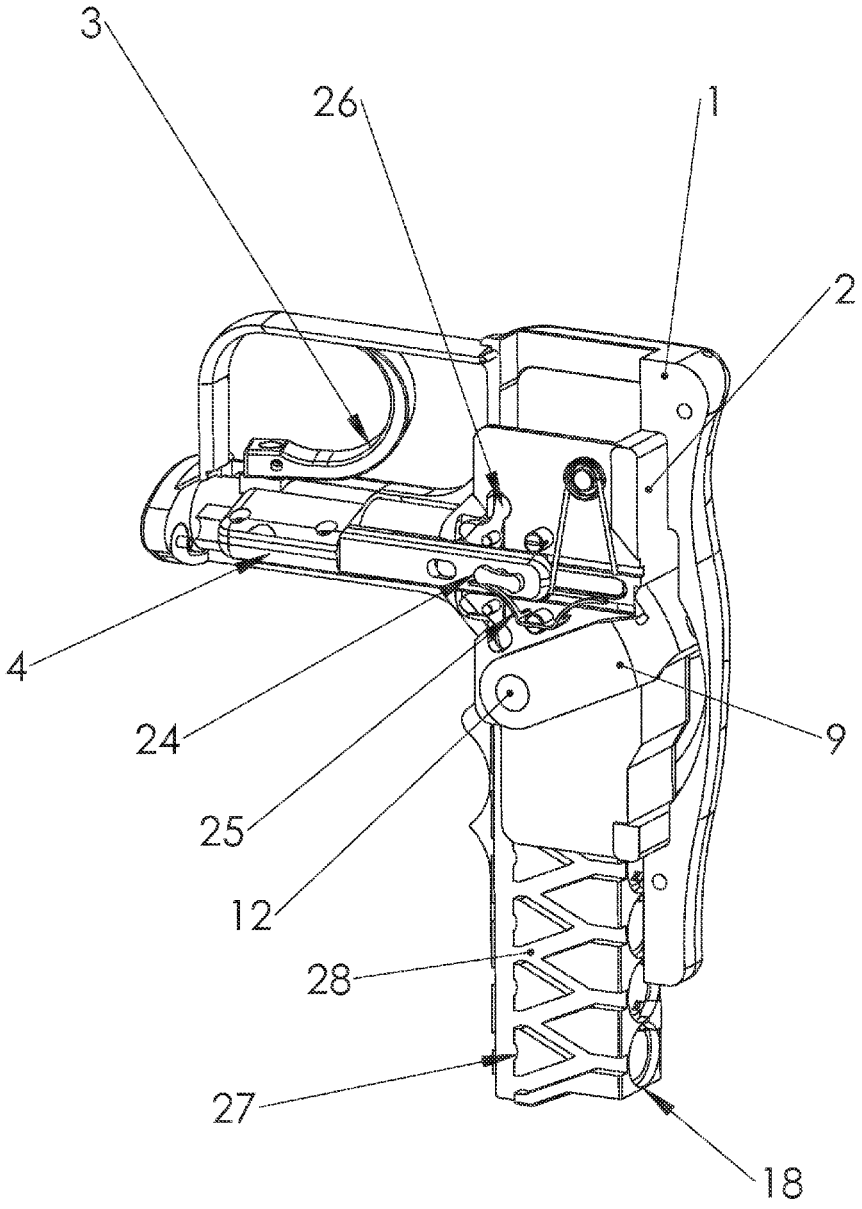
FIG. 2 is a schematic drawing that illustrates a perspective view of the left side of a completely assembled handgun according to one embodiment of the invention.

Referring to FIG. 2, the left side of an embodiment of the invention with a magazine indexing mechanism is shown. Cam lever 24 is an integral actuating lever and cylindrical shaft to support an elliptical shaped cam follower 34 (not shown in this Figure but shown in FIGS. 8 through 13). Cam lever 24 is rotatably mounted in a hole in trigger slide 4. A bias leaf spring 25 engages cam lever 24 and tilts the angle of cam lever 24 and the attached cam follower 34 in a clock wise direction when trigger slide 4 is forward and in a counter-clockwise direction when trigger slide 4 is retracted. Bias spring 25 is mounted in a mating and confining slot in inner frame 2. Magazine locating detent fingers 26 are rotatably mounted in inner frame 2 and engage detent notches 27 in magazine 18. Detent fingers 26 are actuated by cam surfaces on trigger slide 4. The cam surfaces on trigger slide 4 engage mating surfaces on detent fingers 26 when trigger slide 4 is either in the full forward position or in the full retracted position. In either of those extreme positions the detent fingers 26 are forced into engagement with magazine notches 27. Magazine 18 has integral cam tracks 28 which extend from near the front edge of magazine 18 to the rear edge of magazine 18 and are made of a zigzag shape with straight horizontal sections aligned with the centerline of each cartridge chamber 42 in magazine 18. Hammer 9 is U-shaped and straddles inner frame 2 and is rotatably supported by pivot pins 12 on the left side as well as on the right side of inner frame 2.

Figure 3:
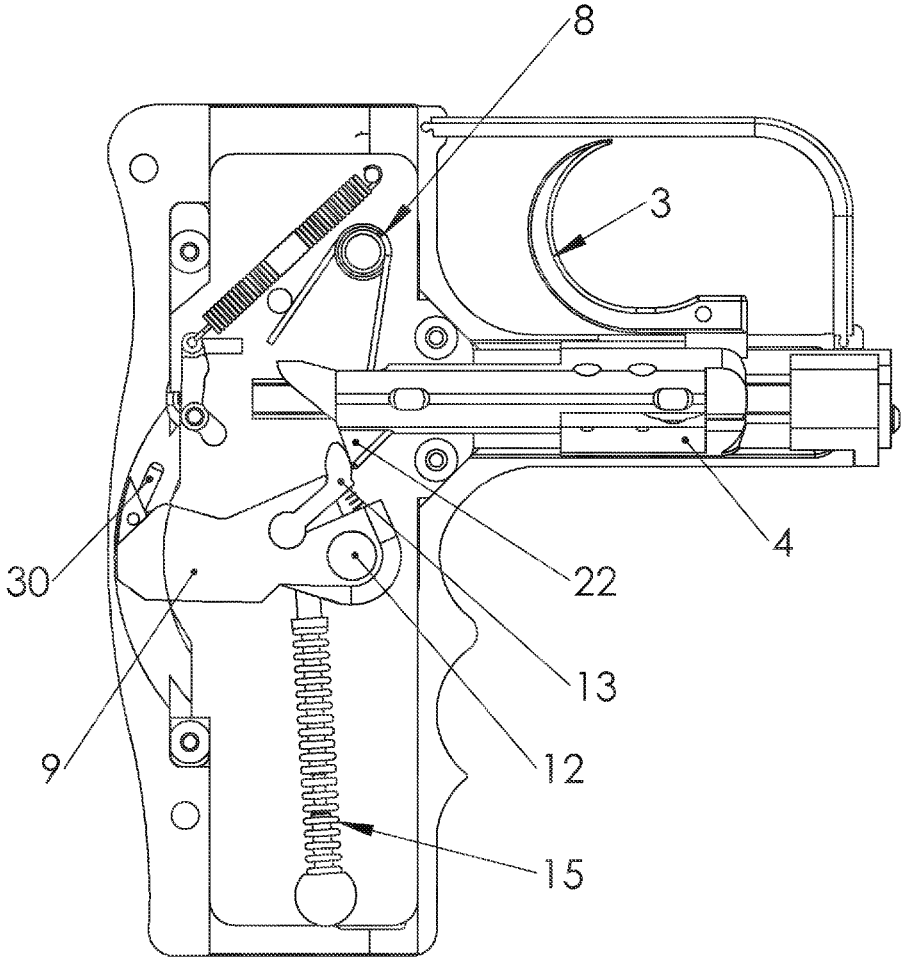
FIG. 3 is a schematic drawing that illustrates a sectional assembly view of a hammer and trigger mechanism with the trigger in the half pulled position according to one embodiment of the invention.

Referring to FIG. 3, a firing mechanism is positioned with trigger slide 4 halfway through the trigger pull stroke. Protrusion 22 on trigger slide 4 has engaged sear 13, which, in turn, has rotated hammer 9 about pivot pins 12 to a position halfway through the hammer travel. The rotation of hammer 9 has compressed hammer spring 15 through half of its travel. The firing pin 30 is now visible protruding from hammer 9 along the centerline of the gun and in line with the center of a cartridge and in line with the center of the gun magazine 18 and barrel 5. The motion of trigger slide 4 acting against trigger torsion spring 8 has compressed spring 8 to its mid-travel position.

Figure 4:
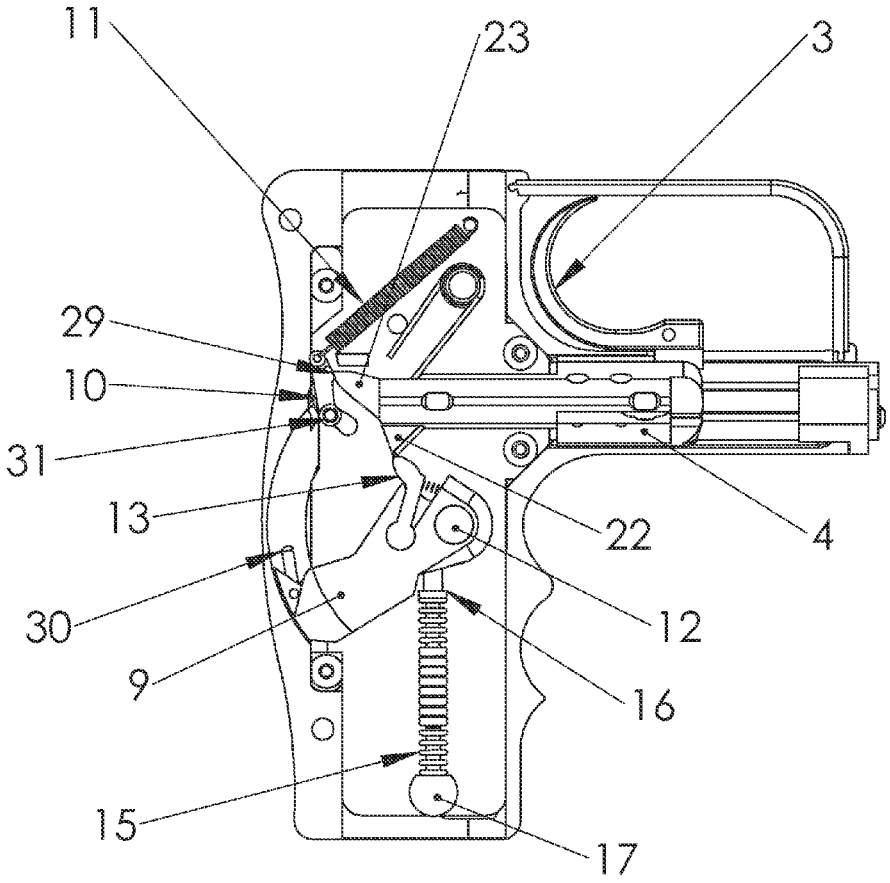
FIG. 4 is a schematic drawing that illustrates a sectional assembly view of a hammer and trigger mechanism with the trigger pulled just to the "trigger trip" position according to one embodiment of the invention.

Referring to FIG. 4 the same firing mechanism shown in FIG. 3 is illustrated with trigger slide 4 pulled back to a "trigger trip" position. Protrusion 23 has engaged hammer relief lever 10 at point 29 and rotated lever 10 about its pivot axis 31 so that it will be clear of hammer 9 when hammer 9 swings up to strike a cartridge in magazine 18 and fire a cartridge. Protrusion 22 on trigger slide 4 has moved to the tip of sear 13 where it will slip off of sear 13 allowing hammer 9 to swing forward rapidly under the pressure of hammer spring 15 acting through hammer spring mandrel 16. Hammer relief lever spring 11 is now extended to nearly its fully extended position.

Figure 5:
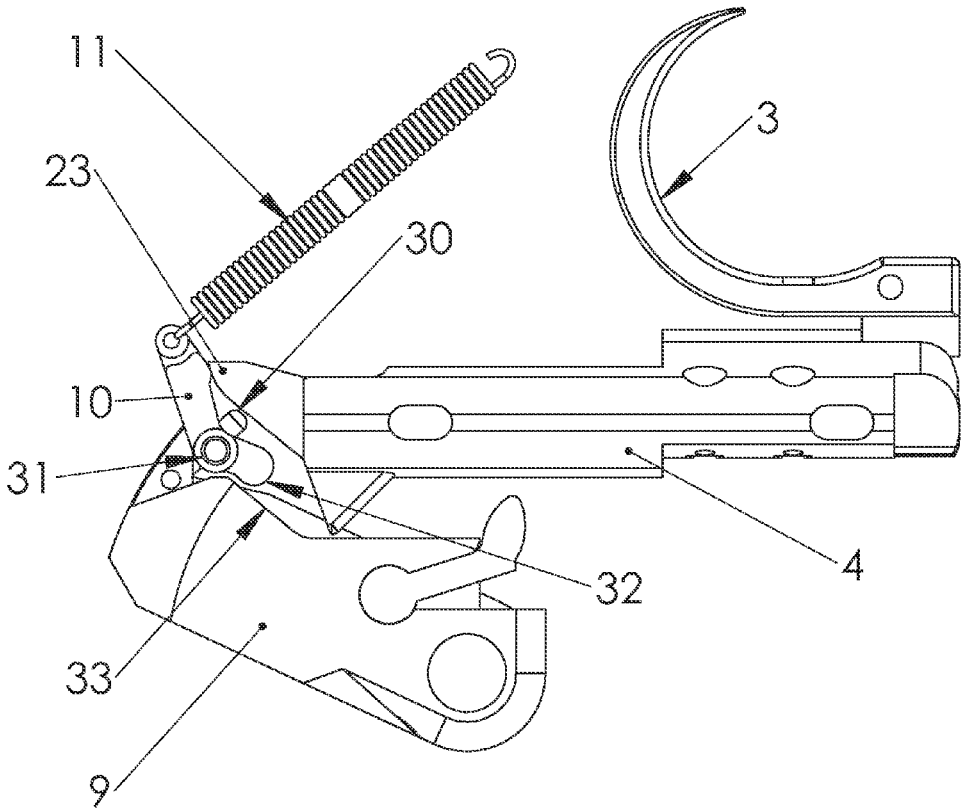
FIG. 5 is a schematic free floating assembly drawing of a firing mechanism and corresponding trigger mechanism in a "just fired" position illustrating a trigger slide holding a hammer relief lever in an open or cleared position.

FIG. 5 is a free-floating partial assembly drawing showing the same firing mechanism as shown in FIG. 4 but now in its "just fired" position. Hammer 9 has rotated to its full clockwise (up) position. Firing pin 30 has struck the primer cap of a cartridge (not shown) in the magazine (not shown here, but shown in FIG. 2) at an acute angle, e.g., an angle of approximately a 45° angle, ±20%. Trigger slide 4 is near its fully retracted position where protrusion number 23 has engaged with hammer release lever 10 and rotated lever 10 about its pivot axis 31 thus moving lobe 32 on lever 10 to a position clear of surface 33 on hammer 9.

Figure 6:
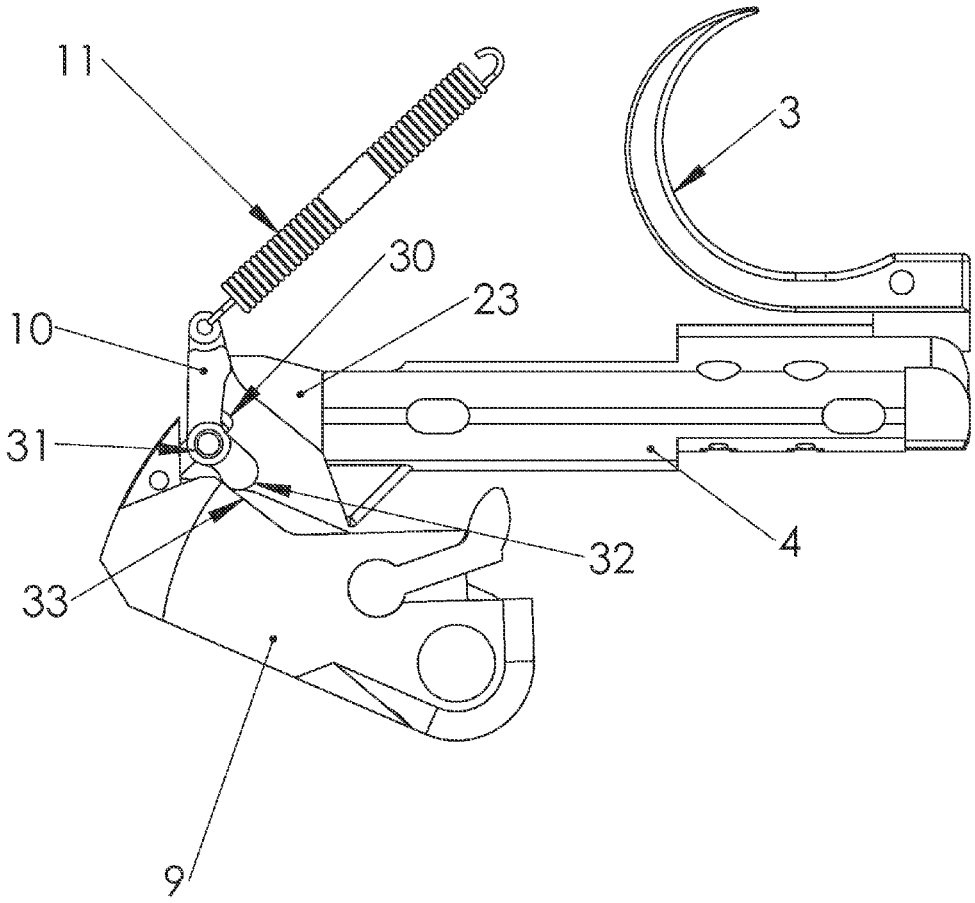
FIG. 6 is a schematic free floating assembly drawing of a firing mechanism and corresponding trigger mechanism at a position just after the trigger starts its return stroke and releases the hammer relief lever.

FIG. 6 is a free-floating partial assembly schematic drawing showing a firing mechanism in a position with trigger slide 4 just beginning a release or return stroke. The slight forward motion of trigger slide 4 and protrusion 23 allows hammer relief lever 10 to rotate clockwise about its pivot axis 31. The rotation of lever 10 brings lobe 32 into contact with surface 33 on hammer 9 thus rotating hammer 9 counterclockwise a sufficient amount to retract firing pin 30 clear of a cartridge and clear of the magazine chamber. This will allow magazine 18 to index freely through the magazine chamber.

Figure 7:
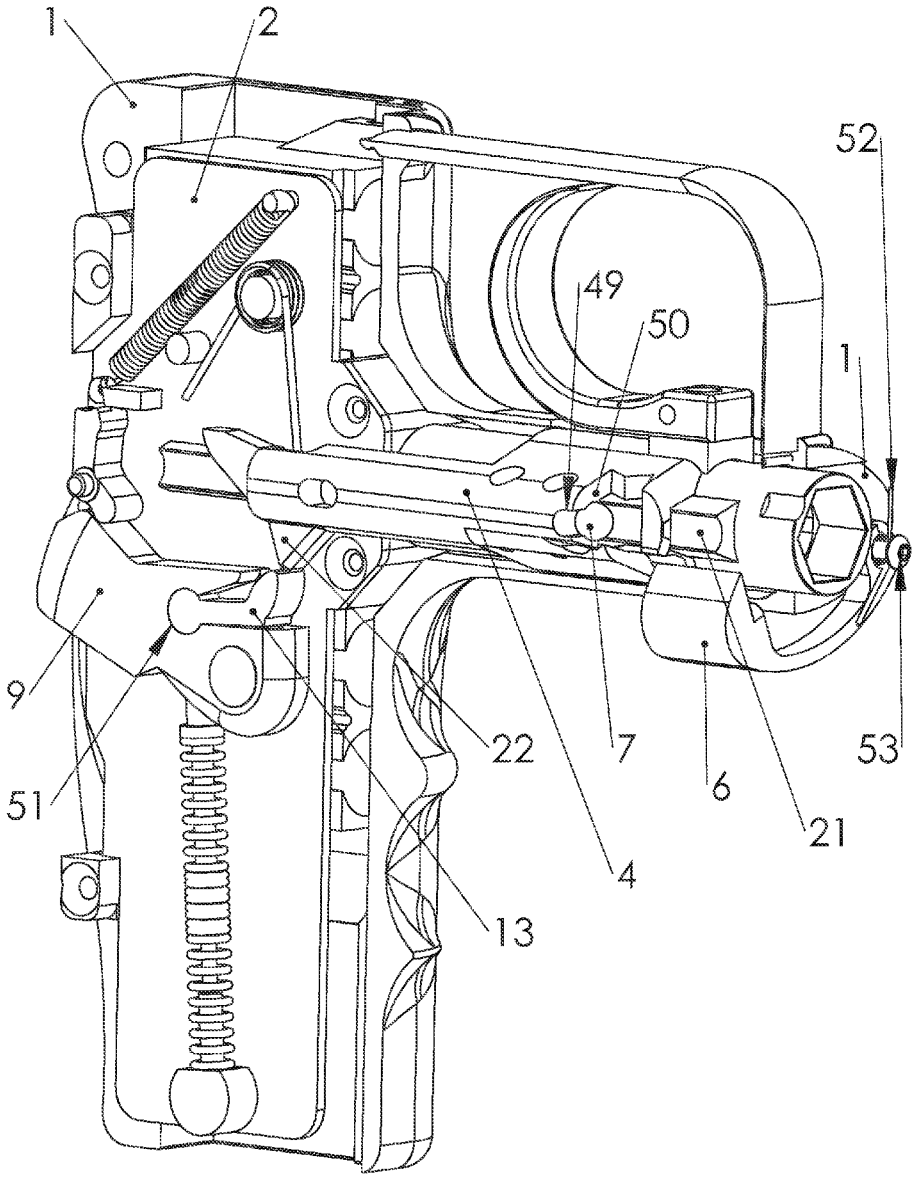
FIG. 7 is a schematic free floating assembly drawing of a firing mechanism and corresponding trigger mechanism with the trigger near the end of the return stroke showing the depressing and resetting of the sear. A ball bearing arrangement on the trigger slide is also illustrated.

FIG. 7 is a schematic assembly drawing showing a firing mechanism with trigger slide 4 near the end of its return stroke approaching the "at rest" position. Protrusion 22 on trigger slide 4 has engaged the back surface of sear 13 and caused sear 13 to rotate about its pivot surface 51 in hammer 9. The rotation of sear 13 allows protrusion 22 to pass by sear 13 as trigger slide 4 continues its return motion. Once protrusion 22 on trigger slide 4 passes sear 13, sear 13 may spring back up to its engaging position under the pressure of sear compression spring 14.

Trigger slide 4 has been cutaway in the area of bearing ball 7 to make visible the mounting of bearing ball 7. Spherical pocket 50 is machined into trigger slide 4 to match the outside diameter of bearing ball 7. Relief slot 49 is cut horizontally through spherical pocket 50 to clear the midsection of ball 7. This allows ball 7 to rotate freely about its vertical axis (North-South Poles) with no contact between trigger slide 4 and the midsection (equator) of ball 7. Ball 7 rolls along its midsection (equator) in curved track 21 in inner frame 2. Mounting trigger slide 4 in bearing balls 7 not only provides smooth easy motion of trigger slide 4 but also provides accurate lateral and vertical motion location for trigger slide 4.

Trigger stop 6 is pivotally mounted to the outer frame 1 around mounting screw 53. Trigger stop 6 is urged in a clockwise or closed position by torsion spring 52 mounted concentric with screw 53 and with one spring leg in lever 6 and the other spring leg in outer housing 1. Trigger stop lever 6 stops the forward motion of trigger slide 4 to determine its forward or at rest position. When trigger stop 6 is depressed counterclockwise, trigger slide 4 may move forward a given distance more before coming to rest against outer frame 1. The additional forward motion of trigger slide 4 disengages cam follower 34 (34, 28 and 18 not shown here but shown in FIG. 8 through 13) from cam track 28 in magazine 18 allowing magazine 18 to be removed from the gun.

Figure 8:
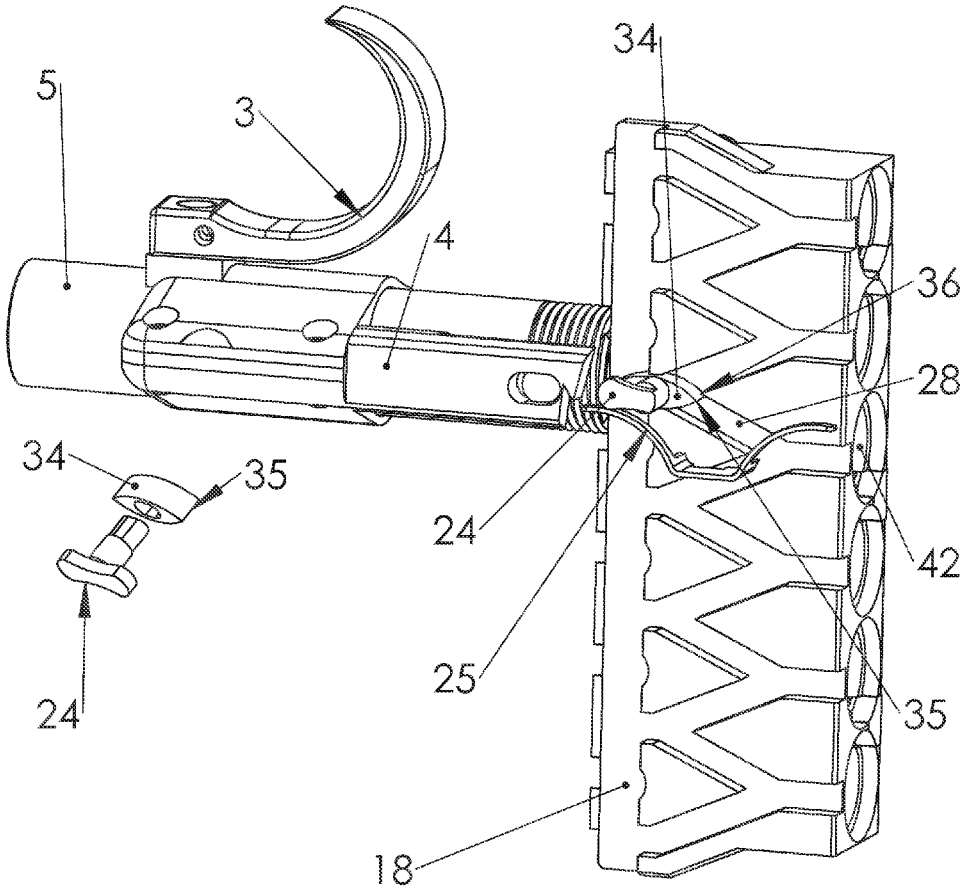
FIG. 8 is a schematic free floating assembly drawing of a magazine indexing mechanism at the beginning of a trigger pull and magazine indexing cycle.

FIG. 8 is a free-floating schematic assembly drawing showing a magazine indexing system according to one embodiment of this invention. Cartridge magazine 18 has multiple parallel cartridge chambers 42 to hold cartridges and serve as firing chambers. A face of magazine 18 has zigzag cam tracks 28 to facilitate indexing and accurately positioning successive chambers 42 in magazine 18 in line with barrel 5. Elliptical shaped cam follower 34 engages tracks 28 in magazine 18. Cam follower 34 is securely engaged in cam lever 24 (see inset sub-assembly for clarity). Cam lever 24 is rotatably mounted about its central axis in a bore in trigger slide 4 (see FIGS. 2 and 13 for additional clarity). Cam lever 24 is shown partially cutaway in the major assembly drawing of FIG. 8 to make cam follower 34 more visible for clarity. Trigger slide 4 is shown in a position shortly after the beginning of a trigger pull cycle. In this position, the left lobe of cam lever 24 engages bias leaf spring 25 thus rotating cam lever 24 and cam follower 34 clockwise. The clockwise rotation positions leading edge 35 of cam follower 34 below junction 36 in cam track 28 and directs cam follower 34 into the lower channel of cam track 28. Cam follower 34 mounted in trigger slide 4 will travel horizontally and passing through the lower channel of track 28 will cause magazine 18 to move in an upward vertical direction.

Figure 9:
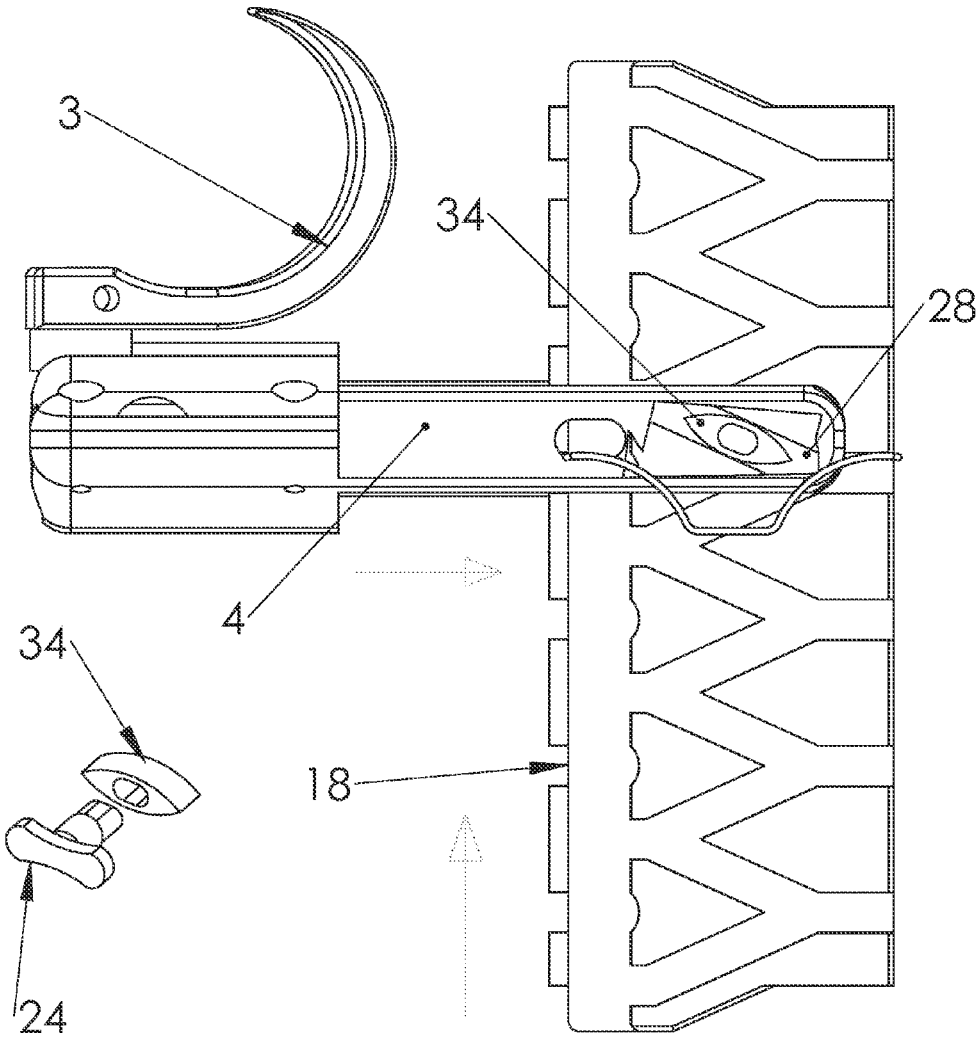
FIG. 9 is a schematic free floating assembly drawing of a magazine indexing mechanism at the middle of a trigger pull and one quarter way through the magazine indexing cycle.

FIG. 9 is a free-floating partial assembly schematic drawing showing the magazine index system illustrated in FIG. 8 with trigger slide 4 in its mid-pulled position. Trigger slide 4 has been moved horizontally to the right and cam follower 34 has progressed down cam track 28 in magazine 18 and moved magazine 18 vertically upward.

Figure 10:
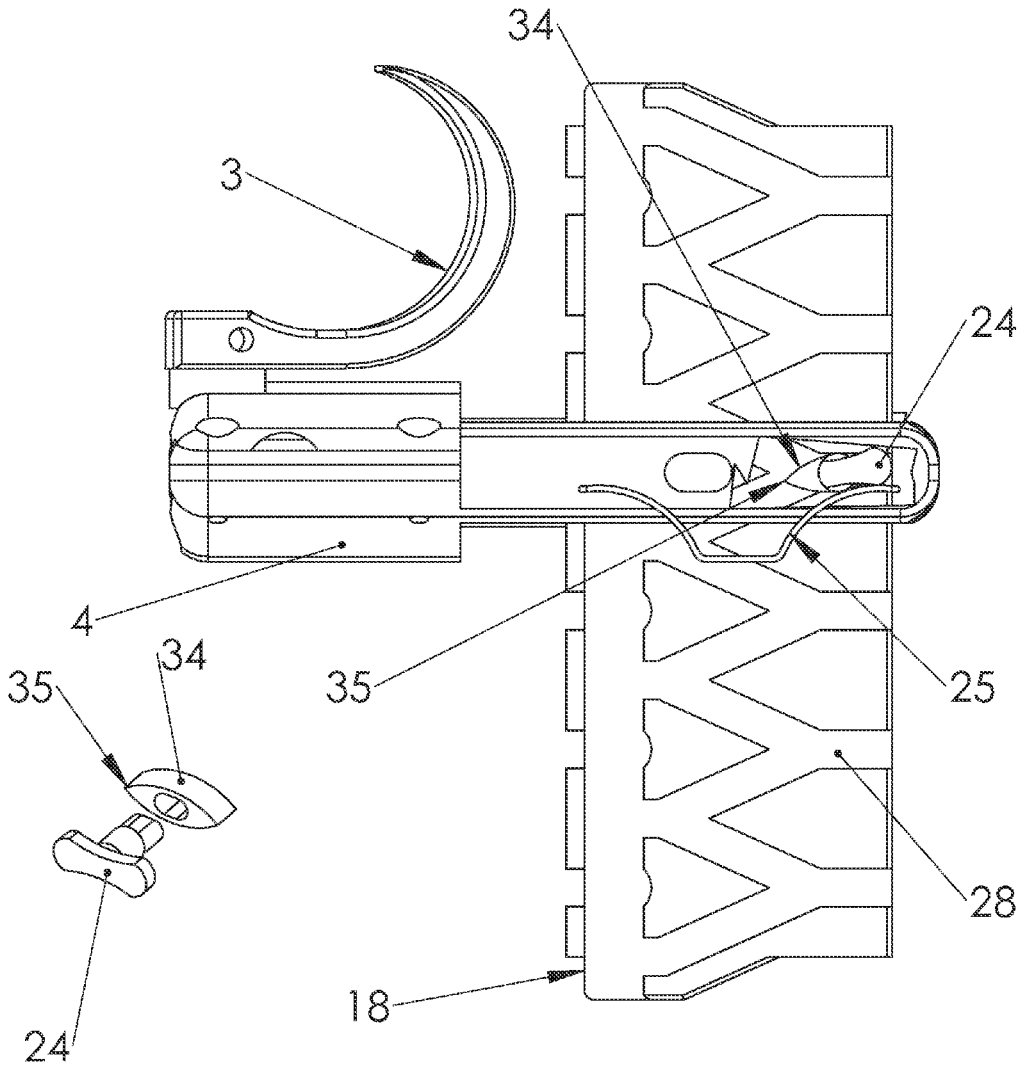
FIG. 10 is a schematic free floating assembly drawing of a magazine indexing mechanism at the end of a trigger pull and one half way through the magazine indexing cycle.

FIG. 10 shows the same magazine indexing mechanism shown in FIGS. 8 and 9. In FIG. 10, the trigger slide 4 is pulled back to its full compressed position and trigger slide 4 is at the extreme right end of its travel as viewed in FIG. 10. Cam follower 34 is engaged in the horizontal "dwell" portion of cam track 28. This positions a firing chamber 42 into alignment with barrel 5 and a cartridge in that chamber would have been fired. The right lobe of cam lever 24 has engaged bias leaf spring 25 and rotated cam follower 34 in a counterclockwise position (the left side of cam lever 24 has been cut away to expose cam follower 35 for clarity). This positions the leading edge 35 of cam follower 34 in a downward position and below the centerline of the horizontal "dwell" portion of cam track 28.

Figure 11:
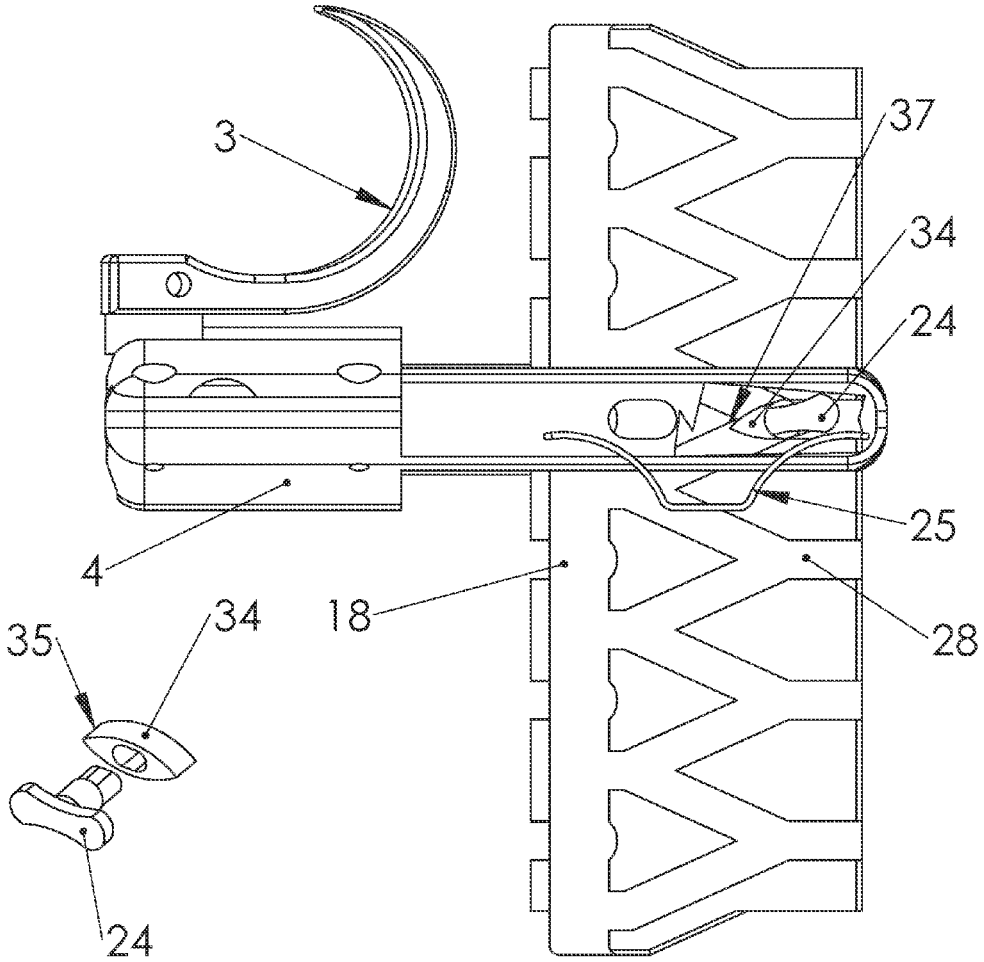
FIG. 11 is a schematic free floating assembly drawing of a magazine indexing mechanism with the trigger beginning the return stroke and the magazine beginning the second half of the indexing cycle.

FIG. 11 shows the same magazine indexing mechanism illustrated in FIGS. 9 and 10. In FIG. 11, trigger slide 4 has begun its return stroke and has moved slightly to the left from the position shown in FIG. 10. Cam follower 34 has been tilted counterclockwise and leading edge 35 on cam follower 34 is below the junction point 37 in cam track 28. The left portion of cam lever 24 has been cutaway to make cam follower 34 more visible. With cam follower 34 directed into the lower channel of track 28, the magazine will index vertically upward with the continued return travel of trigger slide 4.

Figure 12:
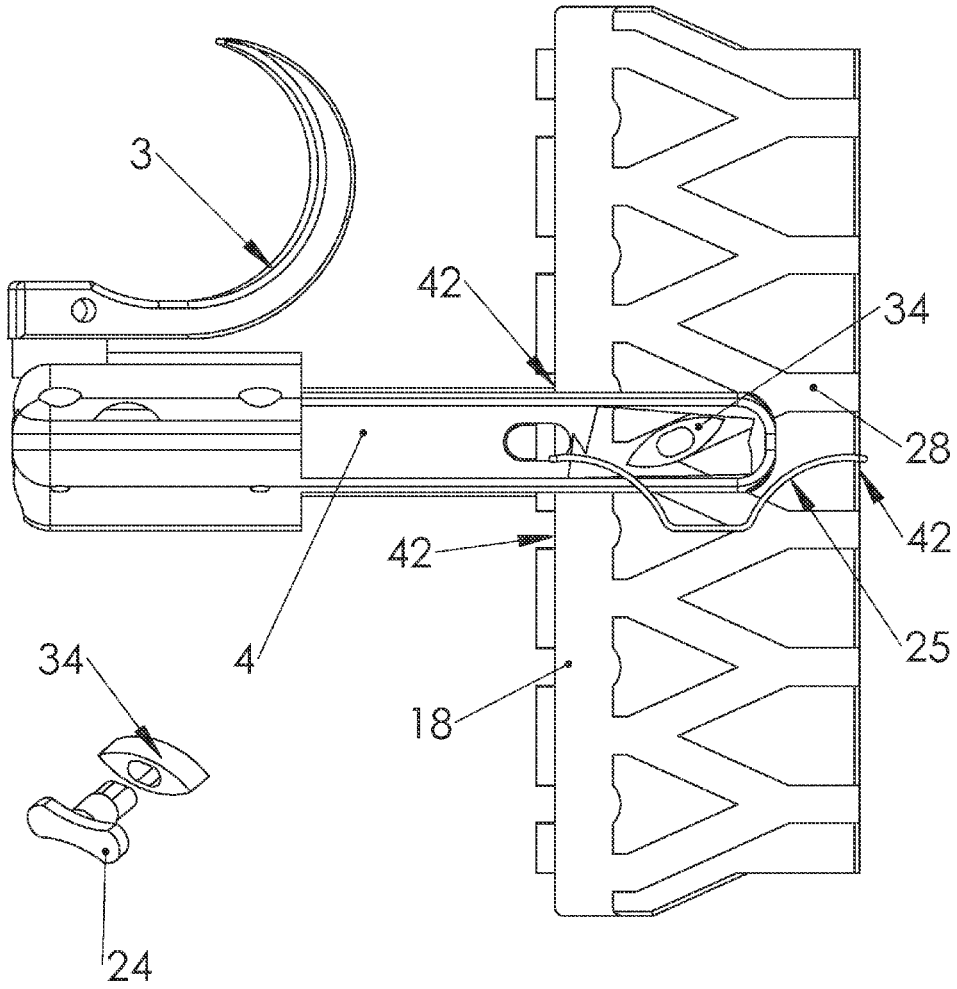
FIG. 12 is a schematic free floating assembly drawing of a magazine indexing mechanism at the middle of a trigger return stroke and the magazine three quarters of the way through the magazine indexing cycle.

FIG. 12 shows the same magazine indexing system as illustrated in FIG. 11 but with trigger slide 4 nearing the end of its return stroke to the left. The horizontal movement of cam follower 34 through the lower channel of cam track 28 has indexed magazine 18 up in a vertical direction. When trigger slide 4 completes its return stroke and is in its full left position, magazine 18 will be indexed up one half of the distance between successive firing chambers 42. This will place firing chambers 42 out of reach of firing pin 30 and leave the gun in a safe state.

Figure 13:
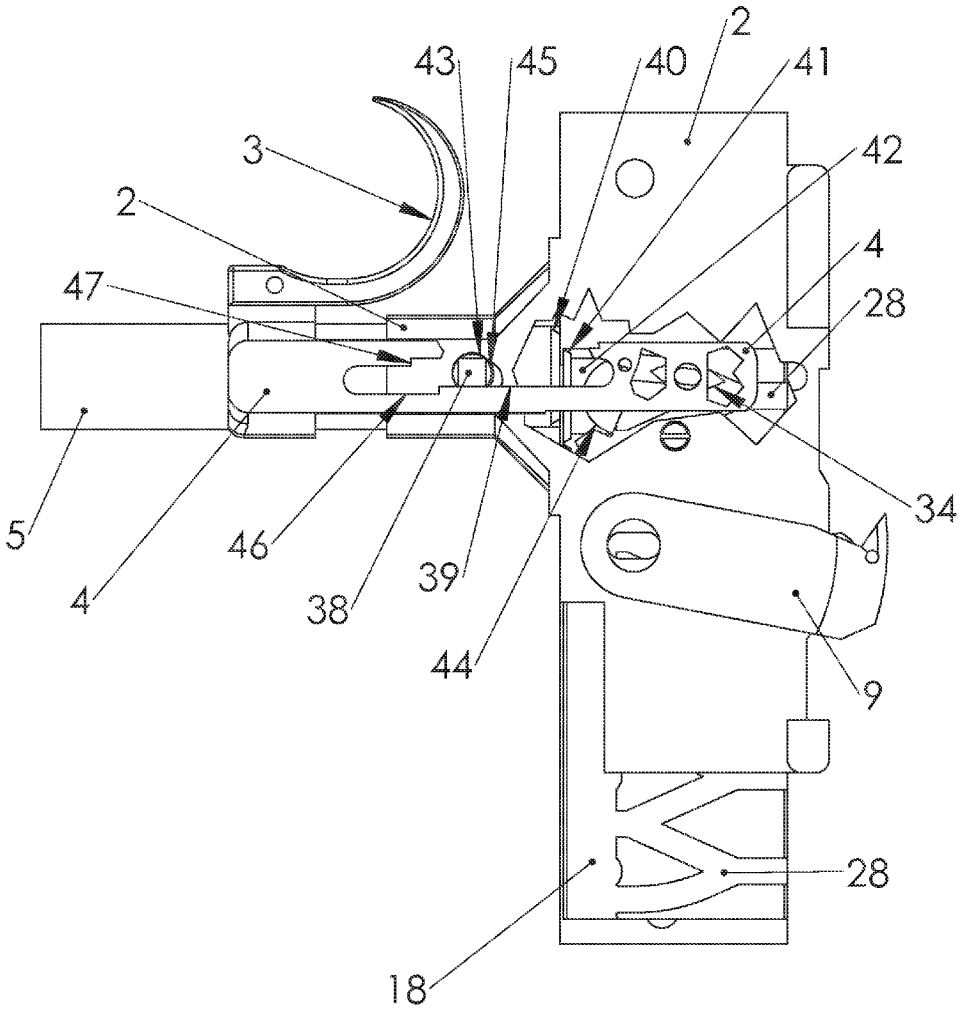
FIG. 13 is a schematic free floating assembly drawing showing a magazine and barrel alignment system in a position just prior to the alignment action.

FIG. 13 is a schematic assembly drawing with broken out sections to illustrate a barrel and magazine alignment mechanism. The magazine indexing system is the same as that illustrated in FIGS. 8 through 12. Parts of trigger slide 4 and inner frame 2 have been broken out to expose components of the barrel and magazine locating mechanisms of this embodiment. In this embodiment, barrel 5 is free to float horizontally in its locating bore in inner frame 2 and is free to rotate about its bore centerline within limits controlled by cylindrical sections 45 (see FIG. 14) of studs 38 on barrel 5 being confined in spiral slots 43 in inner frame 2. Slot 43 on the near side of inner frame 2 is spiraled down and to the right. Corresponding slot 43 on the opposite side of inner frame 2 spirals up and to the right. Any horizontal movement of barrel 5 will be accompanied by a circular rotation of barrel 5 about its central axis thus creating a spiral movement of barrel 5. Studs 38 on barrel 5 extend out from barrel 5 in both directions and extend through spiral slots 43 in inner frame 2 and into horizontal slots 39 on both sides of trigger slide 4. Barrel 5 has a male conical pilot diameter 40 concentric with the bore of barrel 5. Each chamber 42 in magazine 18 has a matching female conical counter bore 41 at the exit end of each chamber 42. When magazine 18 is indexed to a position where the centerline of barrel 5 and the centerline of a chamber 42 are in close proximity and barrel 5 is moved toward magazine 18, conical pilot 40 on barrel 5 will engage conical counter bore 41 in a chamber bore 42 and accurately align the bore of barrel 5 with the bore of a chamber 42.

Figure 14:
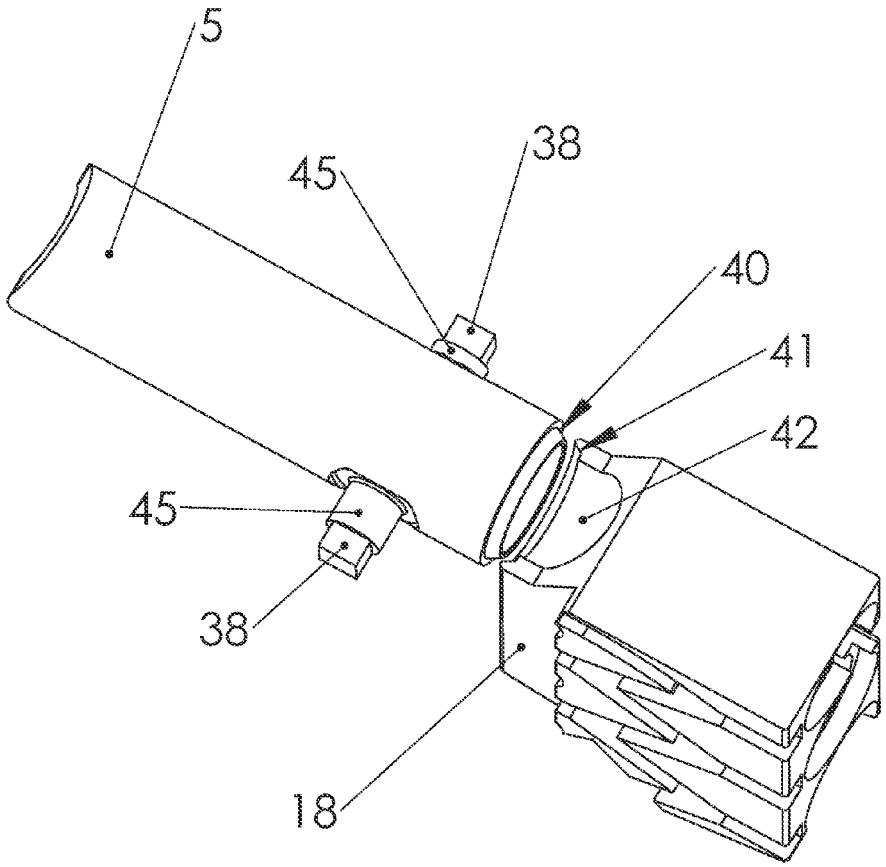
FIG. 14 is an isometric schematic free floating assembly drawing showing a barrel and magazine and illustrating the features of an alignment system.

FIG. 14 is a free-floating isometric schematic drawing showing the relative position of barrel 5 and magazine 18 in their disengaged position. A portion of magazine 18 has been cutaway to make visible a portion of a bore 42 with its corresponding tapered pilot counter bore 41. The cylindrical portions 45 of barrel studs 38 are visible in FIG. 14.

Figure 15:
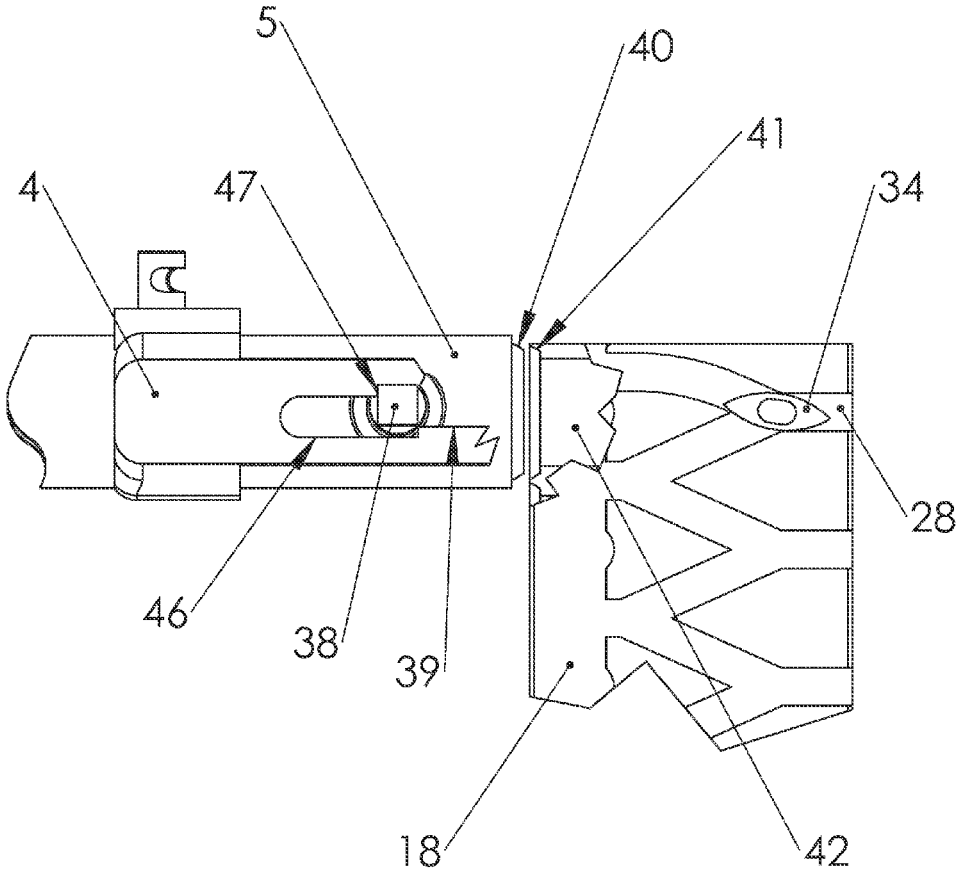
FIG. 15 is a schematic free-floating assembly drawing showing a barrel and magazine alignment system positioned at the beginning of the alignment action.

FIG. 15 is a side elevation schematic subassembly drawing showing magazine 18 in aligned position with barrel 5 and shows a broken away portion of trigger slide 4. Trigger slide 4 has been drawn back by the shooters trigger finger to a position before trigger trip just as magazine 18 is indexed up by cam follower 34 engaged in 28 to a point where a firing chamber 42 is aligned with barrel 5. Barrel studs 38 have been confined in horizontal trigger slide slots 39 during the preceding portion of the trigger pull up to this point. This confinement of barrel studs 38 has prevented barrel 5 from rotating. The confinement of circular portions 45 of barrel studs 38 in the diagonal slots 43 in inner frame 2 has prevented barrel 5 from moving in a longitudinal direction. At the point in the trigger travel shown in FIG. 15, flat cam surface 47 of trigger slide 4 has engaged the flat surface of barrel studs 38. There is clearance below barrel stud 38 in cam track section 46 in trigger slide 4. As trigger slide 4 moves farther back (to the right in FIG. 15) toward magazine 18, flat cam surfaces 47 of trigger slide 4 will force barrel 5 and barrel studs 38 back and down guided by cam studs sections 45 traveling through frame slots 43.

Figure 16:
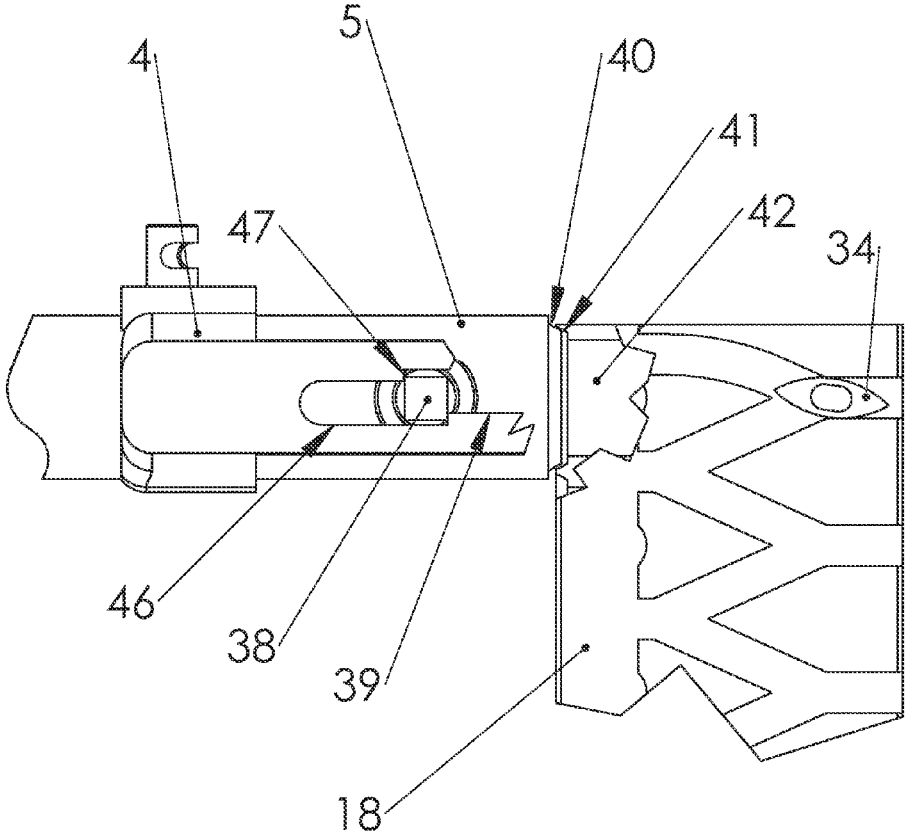
FIG. 16 is a schematic free-floating assembly drawing showing a barrel and magazine alignment system positioned mid way through the alignment action.

FIG. 16 shows the same schematic subassembly as shown in FIG. 15 with trigger slide 4 pulled back farther in its travel toward magazine 18. Barrel 5 has been pulled back (to the right) along with trigger slide 4. Conical pilot diameter 40 of barrel 5 has begun engagement with conical counter bore 41 in a bore 42 in magazine 18. Barrel stud 38 has rotated downward in the cam track in trigger slide 4 guided by diagonal slot 43 in inner frame 2 (see FIG. 13 for additional clarity for referenced component numbers).

Figure 17:
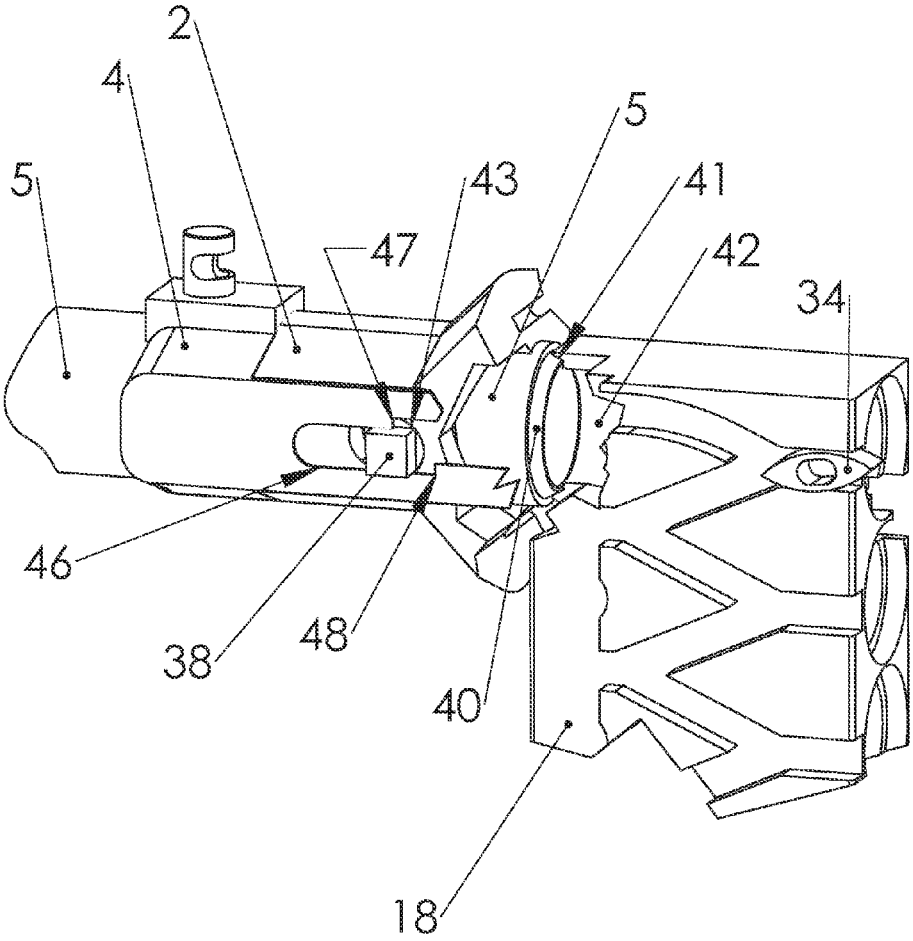
FIG. 17 is an isometric schematic assembly drawing that illustrates a barrel and magazine alignment system at the end of the alignment action with the barrel and magazine locked together.

FIG. 17 shows the same schematic subassembly as that shown in FIG. 16 but with trigger slide 4 pulled back even further in its travel. In FIG. 17, barrel 5 is fully engaged with magazine 18 wherein conical pilot diameter 40 on barrel 5 is fully engaged with conical counter bore 41 of a magazine bore 42. Barrel 5 has rotated and barrel studs 38 have slipped off of flat cam surfaces 47 in trigger slide 4 and barrel studs 38 are now confined in the straight horizontal sections 46 of cam tracks in trigger slide 4 which are offset from horizontal cam track sections 39. In this position, barrel 5 is locked from moving longitudinally by the engagement of diameters 45 of barrel studs 38 being confined in inner frame diagonal slots 43 and from moving rotationally by means of barrel studs 38 being confined in straight sections 46 of cam tracks in trigger slide 4.

Figure 18:
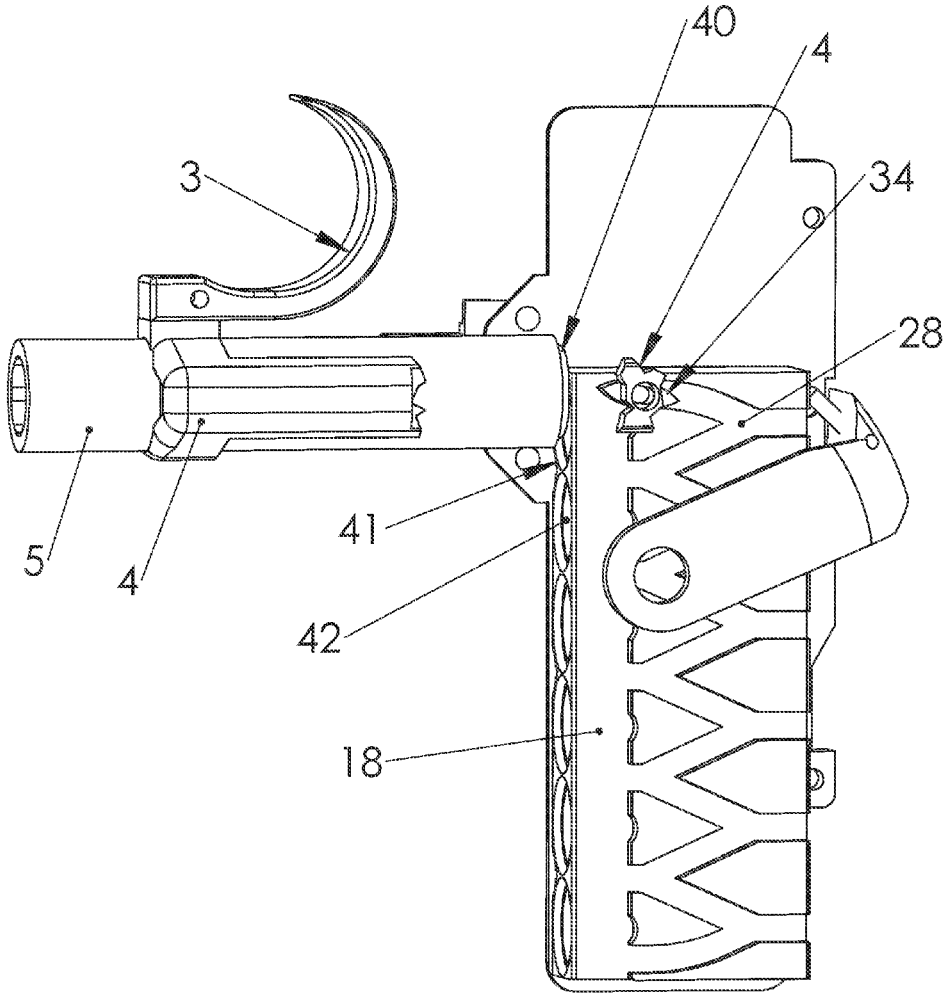
FIG. 18 is an isometric partial assembly schematic drawing illustrating an additional mechanism to align a barrel with a magazine.

FIG. 18 is a free-floating schematic subassembly drawing illustrating a different mechanism to actuate the alignment system between a barrel 5 and successive firing chambers 42 in a magazine 18 similar to the systems described in FIGS. 13 through 17 above. In FIG. 14, the inlet end of barrel 5 has conical pilot diameter 40 and magazine 18 has mating conical counter bores 41 in the exit ends all firing chambers 42. Magazine 18 is indexed up sequentially between successive firing chambers 42 by means of cam follower 34 rotatably mounted in trigger slide 4 and engaging cam tracks 28 cut into the face of magazine 18. The horizontal movement of cam follower 34 guided by trigger slide 4 will move magazine 18 up one half of the successive index distance between successive firing chambers 42 on trigger pull and the other half on trigger release. Straight horizontal portions of cam track 28 on the right-hand side of magazine 18 wherein the centerline bore of a successive firing chamber 42 is in alignment with the centerline bore of barrel 5. FIG. 18 shows the mechanism at the beginning of a trigger pull. Cam follower 34 is at the beginning of a cam track 28 and has positioned magazine 18 at a half index position between successive firing chambers 42. Barrel 5 is in its forward position and there is clearance between the end of conical pilot diameter 40 and the face of magazine 18 thus allowing magazine 18 to be freely indexed upward.

Figure 19:
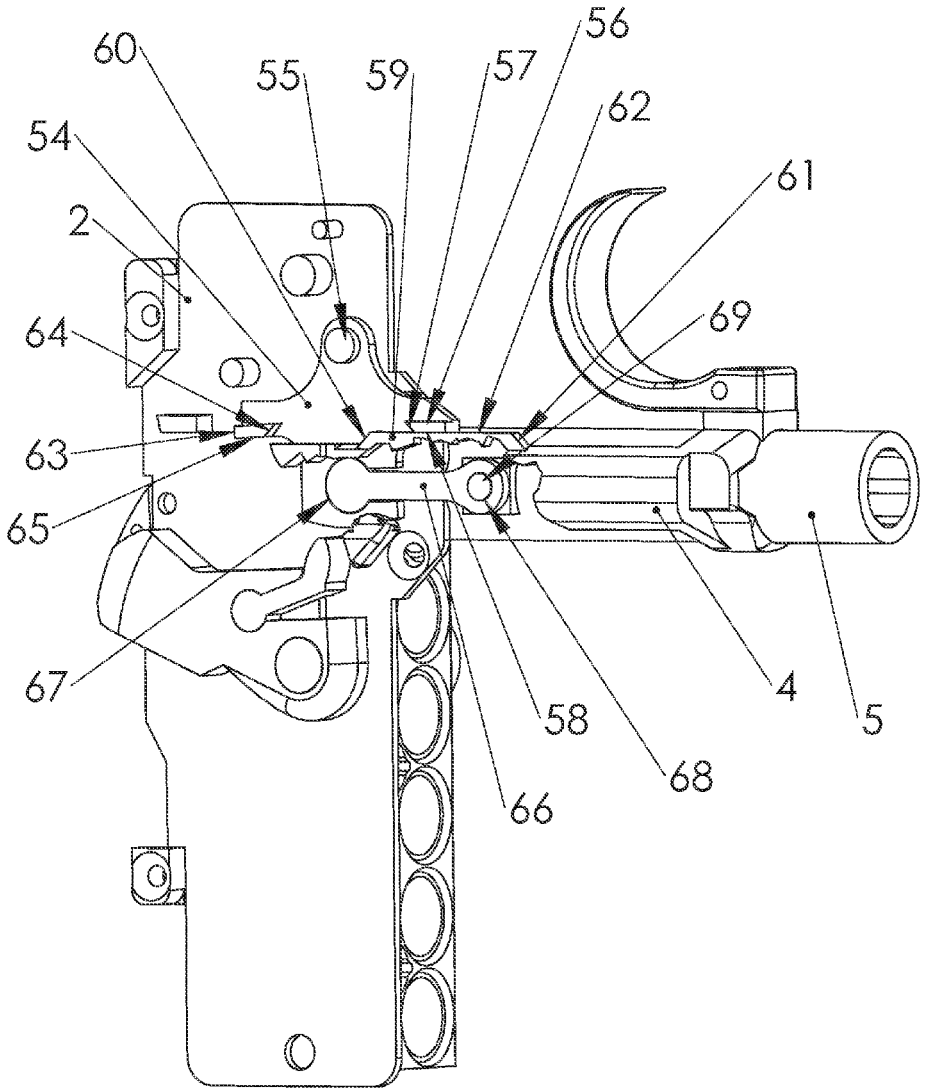
FIG. 19 is an isometric partial assembly schematic drawing showing the right side of the gun illustrated in FIG. 18 and showing the barrel actuating mechanism in an "at rest" position.

FIG. 19 shows the opposite side of the assembly shown in FIG. 18. Barrel positioning lever 54 is pivotally attached to inner frame 2 at Journal 55. Integral to lever 54 are cam protrusions 56 on the forward side and 63 on the rear side. The inclined trailing edge 57 of protrusion 56 is shown. The bottom surface 58 of protrusion 56 is also shown. Similarly, the leading inclined edge 64 and protrusion 63 and 65 is the bottom surface of protrusion 63. A cam protrusion 59 is integral with trigger slide 4. The top surface 62 of cam protrusion 59 is shown. The leading tapered cam surface 60 of cam protrusion 59. The trailing inclined cam surface 61 of cam protrusion 59 is also shown. A connecting link 66 is provided between barrel positioning lever 54 and barrel 5. Link 66 is rotatably journaled in lever 54 at surface 67. Cylindrical stud 69 is integral with barrel 5. Link 66 is rotatably connected to barrel 5 by its engagement with stud 69 at surface 68. Angular rotation of lever 54 about Journal 55 will create linear motion of barrel 5. FIG. 19 shows the mechanism in the same position as shown in FIG. 18 with the barrel forward and trigger slide 4 forward. Surface 58 of protrusion 56 on lever 54 is engaged with surface 62 on cam protrusion 59 of trigger slide 4. This engagement prevents barrel 5 from moving rearward. Horizontal movement of trigger slide 4 will impart no motion to lever 54 with surface 58 engaged with surface 62.

Figure 20:
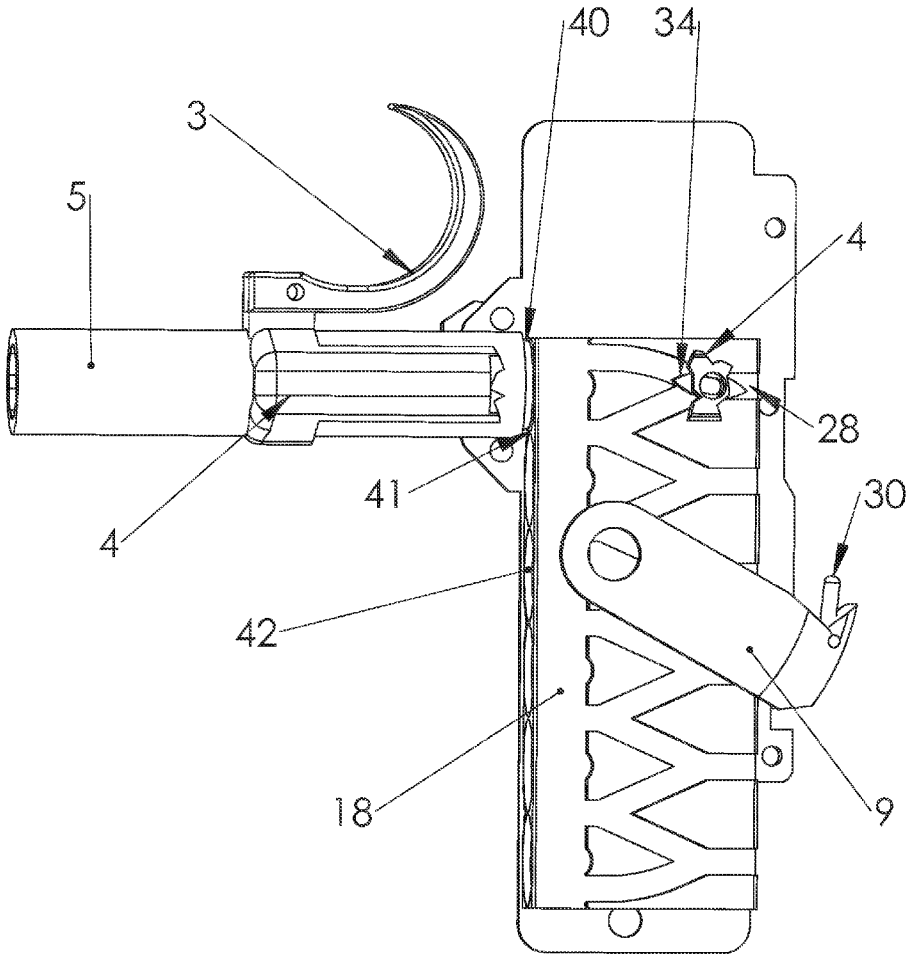
FIG. 20 is a schematic assembly drawing the same as FIG. 18 but with the trigger drawn back to a position where the magazine is approximately aligned with the barrel.

FIG. 20 shows the assembly illustrated in FIGS. 18 and 19 with trigger slide 4 pulled back to a position where cam follower 34 has just entered a straight dwell portion of cam track 28. This has indexed magazine 18 upward and aligned a firing chamber 42 with barrel 5. This also has brought conical pilot diameter 40 in line with a matching conical counter bore 41 in a firing chamber 42. Barrel 5 has begun its rearward travel and has slightly closed the gap between conical pilot 40 and the face of magazine 18.

Figure 21:
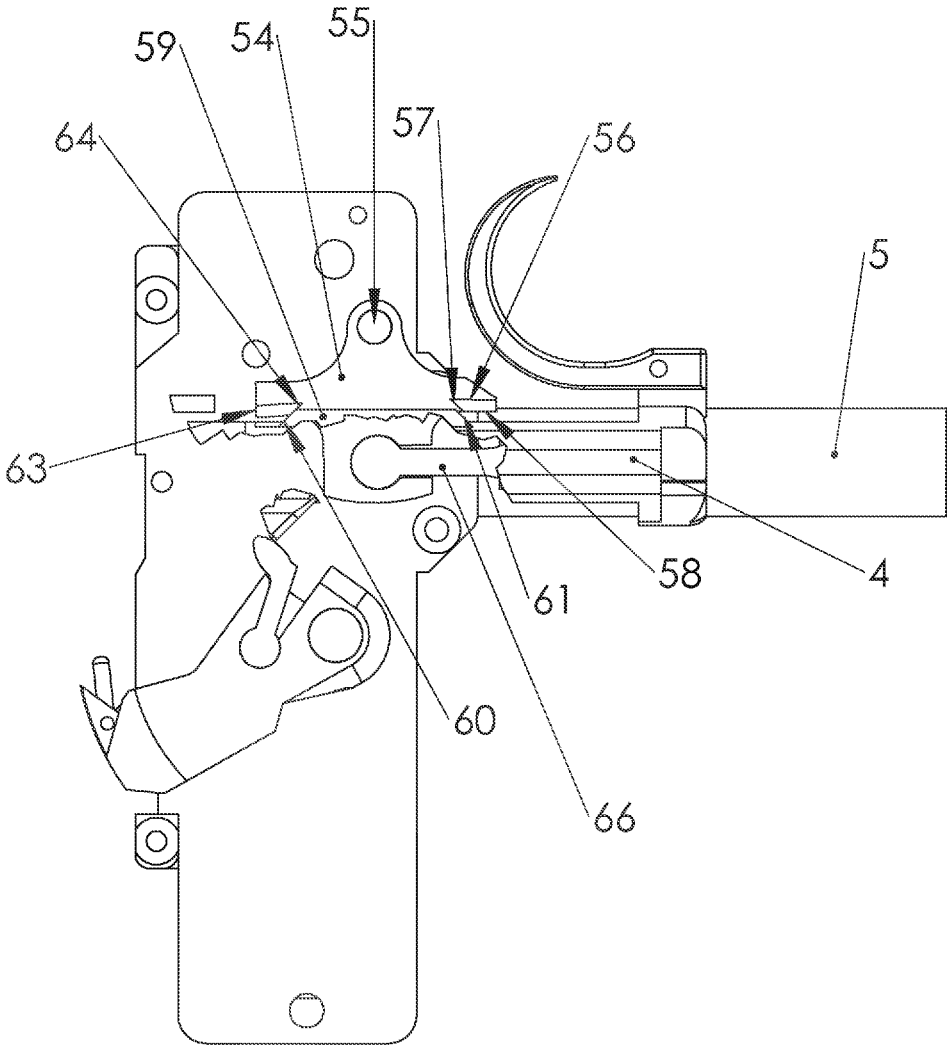
FIG. 21 is a schematic assembly drawing the same as FIG. 19 showing the right side of the gun in the same position as FIG. 20.

FIG. 21 is the opposite side of the assembly shown in FIG. 20. The rearward movement of trigger slide 4 has moved cam protrusion 59 out of contact with surface 58 on cam protrusion 56 of lever 54. There is now clearance between surface 57 on protrusion 56 and surface 61 on protrusion 59. Inclined cam surface 60 of protrusion 59 is now in contact with cam surface 64 on protrusion 63 of lever 54. This movement of trigger slide cam 59 has rotated lever 54 slightly in a clockwise direction which has moved link 66 and barrel 5 rearward toward magazine 18.

Figure 22:
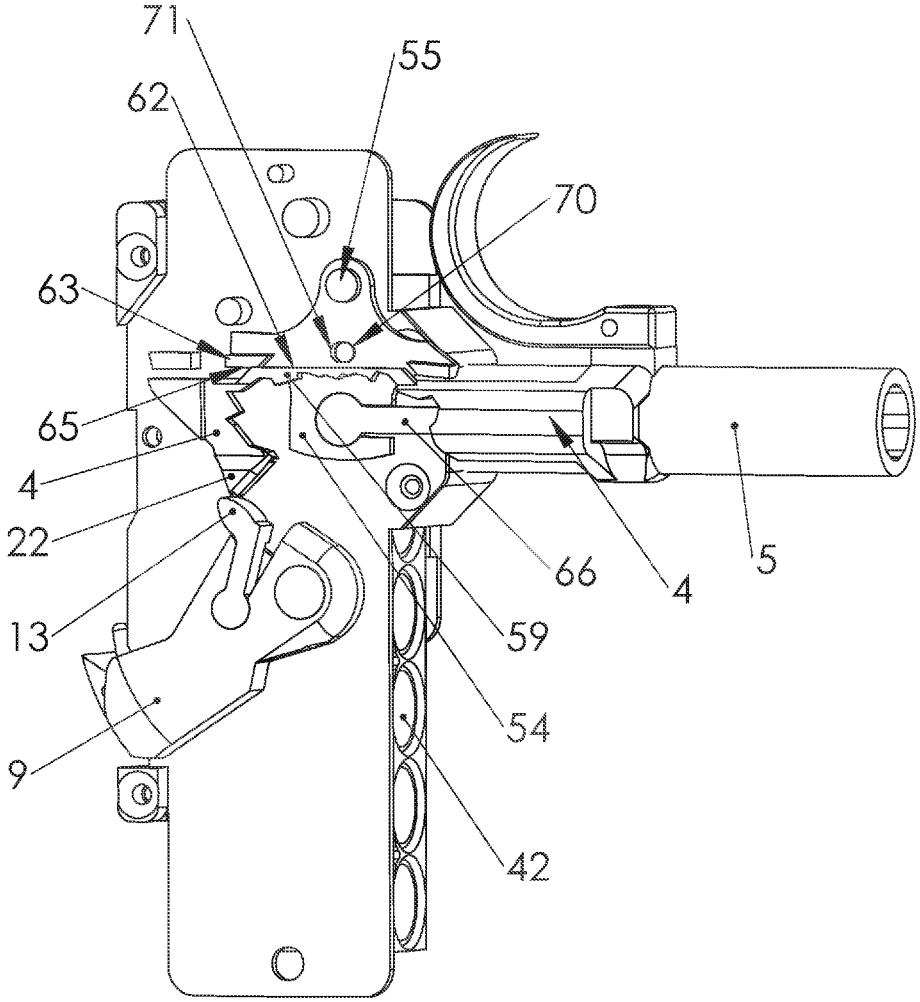
FIG. 22 is the same as FIG. 21 but the trigger has been drawn back to a "just before firing" position illustrating the action of the barrel moving mechanism.

FIG. 22 illustrates the same assembly as that shown in FIG. 21 but with trigger slide 4 drawn back past the position where barrel 5 has been moved to its maximum rearward position. At this position, protrusion 22 on trigger slide 4 is still engaged with sear 13 and hammer 9 is rotated to near its maximum cocked position. Trigger slide 4 must move farther rearward to reach trigger trip position and fire the weapon therefore, barrel 5 is fully engaged and locked into a firing chamber 42 of magazine 18 well before the gun fires. The cam action of cam protrusion 59 on trigger slide 4 acting against protrusion 63 on lever 54 has rotated lever 54 to its full clockwise position. Flat surface 65 on protrusion 63 is now engaged with flat surface 62 on cam protrusion 59 of trigger slide 4. This locks lever 54 in its full clockwise position and any forward force exerted on barrel 5 acting through link 66 will create a downward force but not a forward force on trigger slide 4. The range of angular motion of lever 54 is limited by stud 70 which is attached to inner frame 2, being engaged in slot 71 on lever 54.

Figure 23:
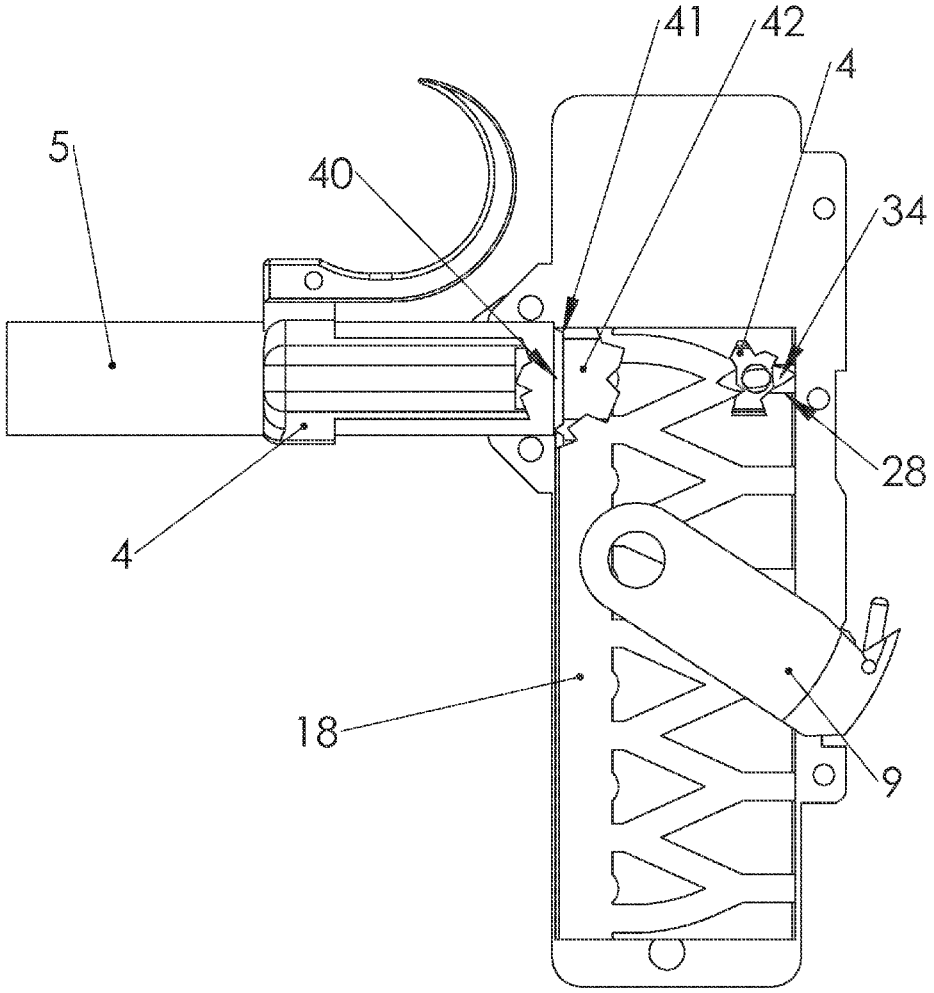
FIG. 23 is the same as FIGS. 18 and 20 above but with the trigger drawn back to the position shown in FIG. 22 above showing the barrel engaged with the magazine.

FIG. 23 is the opposite side of the assembly shown in FIG. 22. Barrel 5 has been drawn back to its full rearward position and conical pilot 40 on barrel 5 can be seen fully engaged with a conical counter bore 41 in a firing chamber 42 of magazine 18. A firing chamber 42 is now accurately located and fully locked with barrel 5. Cam follower 34 is in a straight horizontal dwell portion of cam track 28. Hammer 9 is rotated to near its full cocked position. Trigger slide 4 must continue its rearward travel for some distance further before trigger trip position is reached and hammer 9 swings up and fires the weapon.

Figure 24:
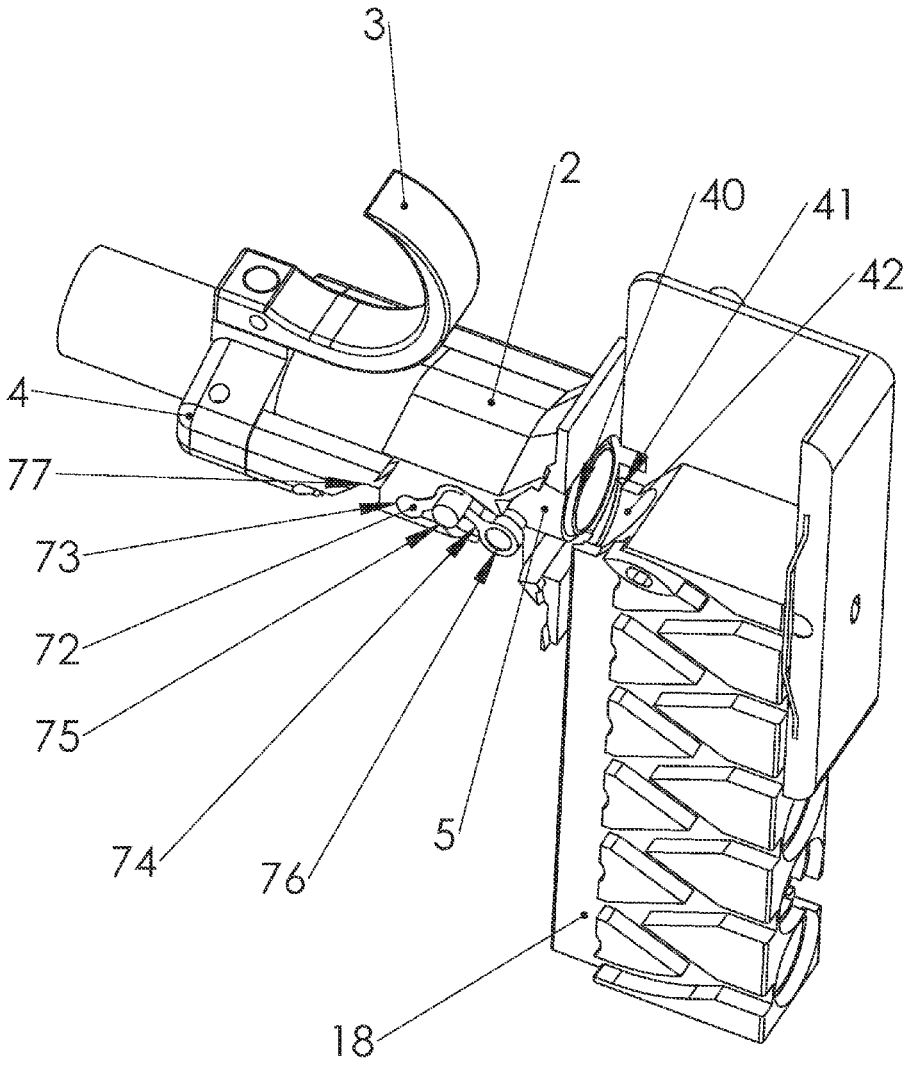
FIG. 24 is an isometric partial assembly schematic drawing of a handgun illustrating yet another mechanism to align a barrel and magazine.

FIG. 24 is a free-floating schematic assembly drawing illustrating an additional method to move barrel 5 into locking position with magazine 18. A primary toggle link 72 has a cylindrical end 73 which is journaled in a matching pocket in inner frame 2. The opposite end of link 72 has a partially open female cylindrical end which is mated with and journaled to a cylindrical boss 75 on a secondary toggle link 74. The opposite end of secondary toggle link 74 has a cylindrical bore which is mated with cylindrical stud 76 which is integral with barrel 5. A similar linkage system exist on the opposite side of the handgun. Cylindrical protrusion 75 on secondary link 74 extends out past the edge of inner frame 2 and into a cam track 77 in trigger slide 4.

Figure 25:
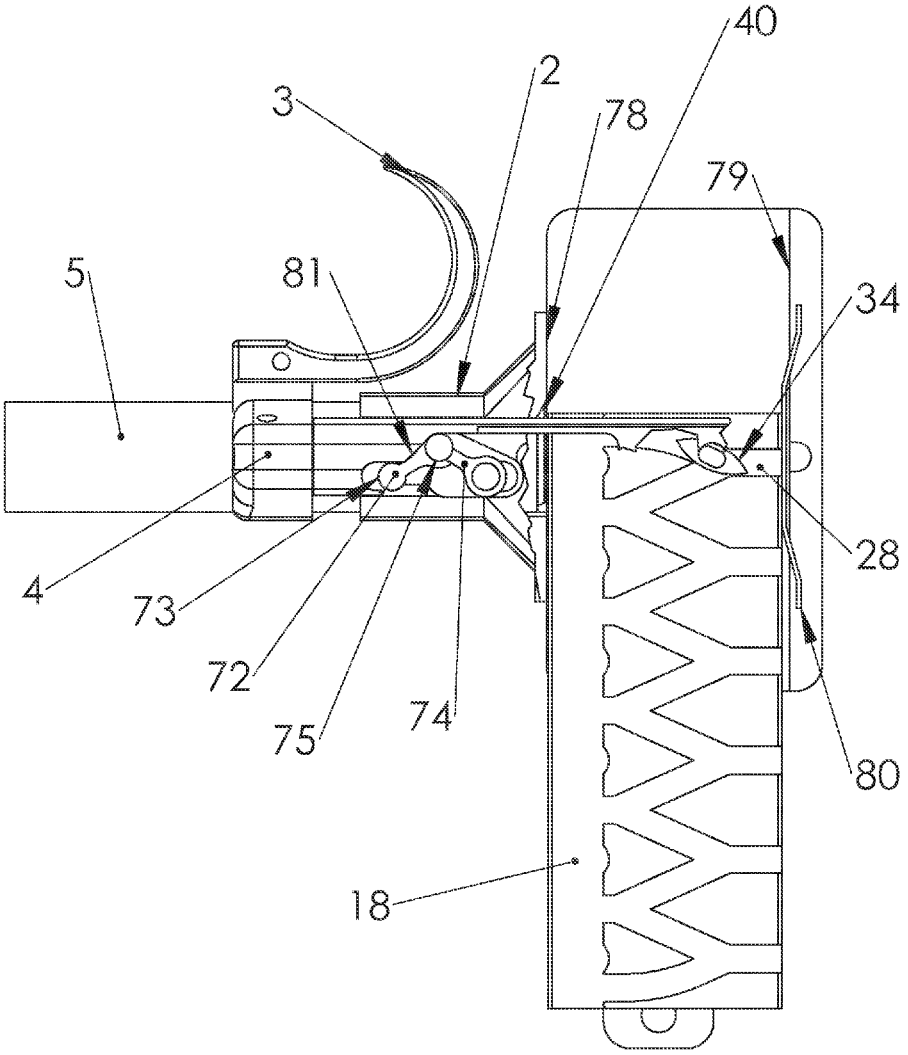
FIG. 25 is a side view of FIG. 24 showing the actuating mechanism at the beginning of its locating operation.

FIG. 25 is a side elevation of the assembly shown in FIG. 24. FIG. 25 shows the toggle linkage with primary link 72 and secondary link 74 inclined to each other at approximately 30°. This position shortens the linkage and draws barrel 5 forward. Cam track 77 in trigger slide 4 is above the centerline of the barrel and positions cylindrical protrusion 75 above the centerline of the pivots on opposite end points of both primary and secondary links 72 and 74 respectively. In FIG. 25, trigger slide 4 is drawn back to a position where magazine 18 has been indexed up to near its firing position by the action of cam follower 34 which is attached to trigger slide 4 being moved through cam track 28 and is approaching a dwell position. Inclined cam surface 81 in trigger slide 4 is now engaged with cylindrical protrusion 75. Further rearward movement of trigger slide 4 will cause cam surface 81 acting on protrusion 75 to rotate primary link 72 about axis 73 in a clockwise direction and reduce the angle between linkage 72 and linkage 74 thus increasing the distance between their respective opposite end center points 73 and 76 and will move barrel 5 rearward.

The magazine channel in inner frame 2 is somewhat wider than magazine 18 allowing for clearance between magazine 18 and the front magazine channel wall 78 and rear magazine channel wall 79. Magazine 18 is positioned forward of rear wall 79 by flat leaf spring 80 mounted in rear wall 79 of the magazine channel in inner frame 2. This forward positioning of magazine 18 places magazine 18 and its associated cartridges clear of firing pin 30 (see FIG. 29) to allow for magazine indexing and prevent the gun from firing accidentally.

Figure 26:
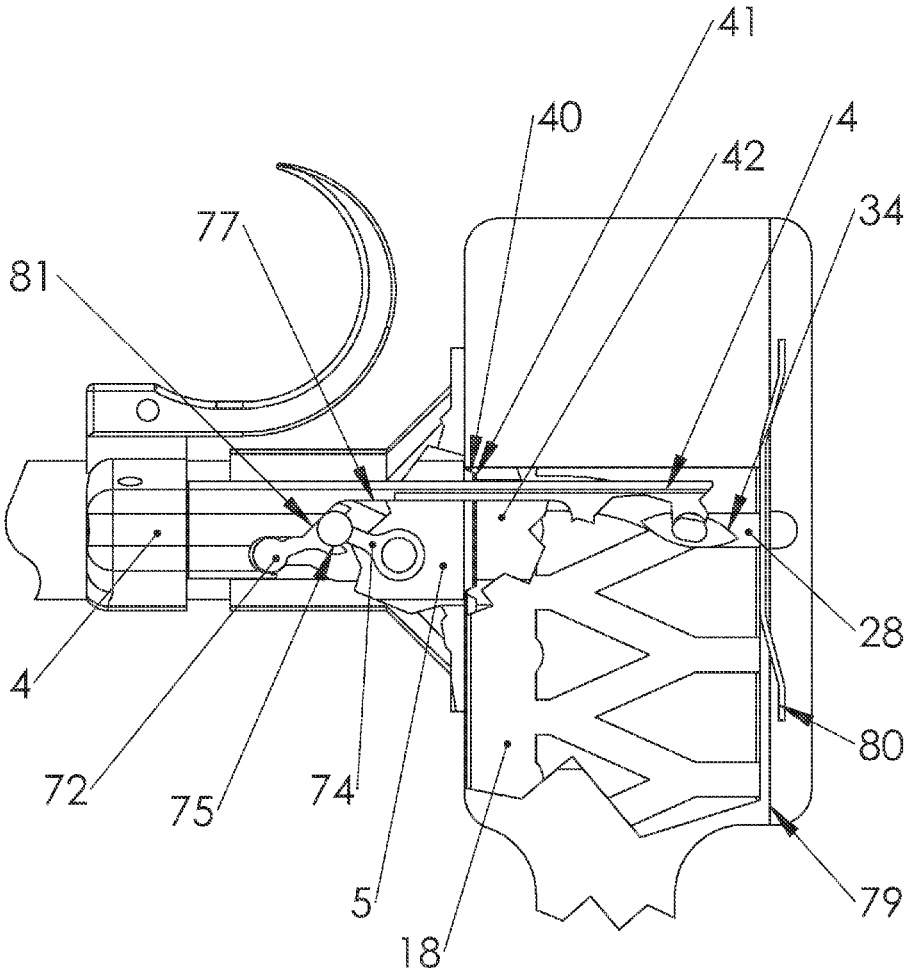
FIG. 26 is the same as FIG. 25 above but with the locating mechanism mid way through its operation.

FIG. 26 is the same assembly drawing illustrated in FIG. 25, but with trigger slide 4 drawn back slightly further. Cam surface 81 on trigger slide 4 has engaged protrusion number 75 and rotated link 72 in a clockwise direction. This action expanded the toggle linkage 72-74 and has moved barrel 5 back to a position where conical pilot protrusion 40 on barrel 5 is engaged in conical counter sink 41 in a firing chamber 42 in magazine 18 and aligned the firing chamber 42 with barrel 5.

Figure 27:
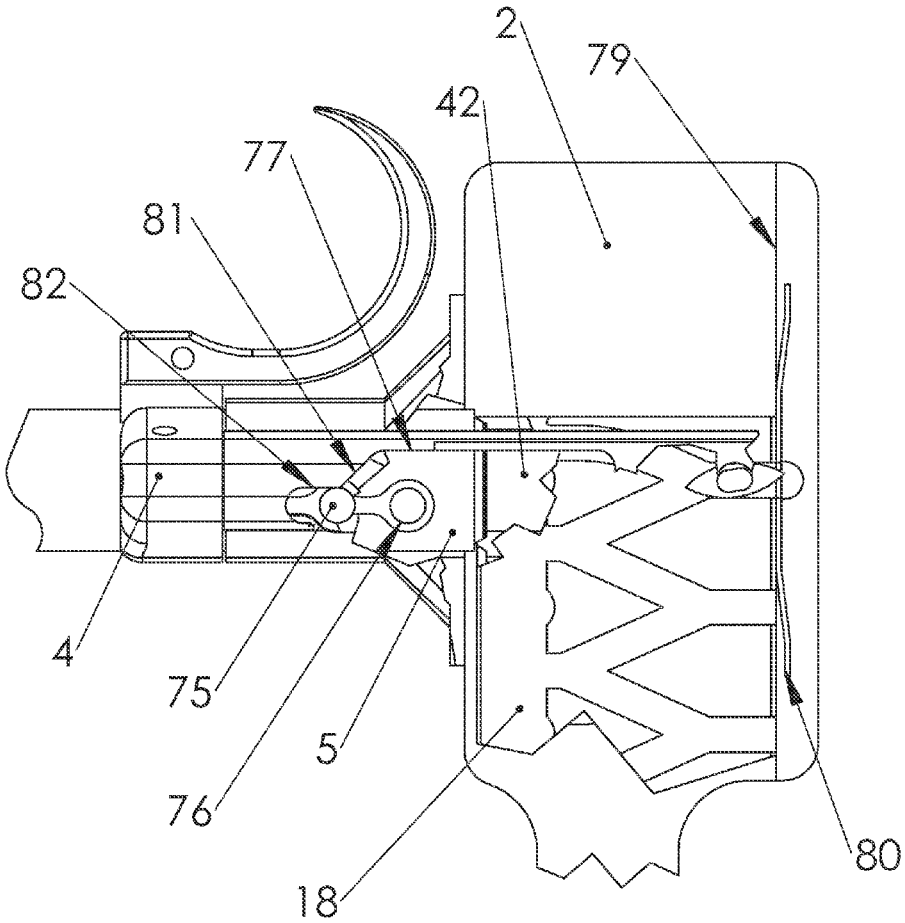
FIG. 27 is the same as FIG. 26 but with the mechanism at the end of its operation and the barrel fully engaged with magazine.

FIG. 27 is the same assembly shown in FIGS. 24 through 26 above but with trigger slide 4 pulled back to a point just before trigger trip and gun firing. Cylindrical protrusion 75 has been forced down by cam track section 81 in trigger slide 4 to a position where all three pivot points, 73, 75 and 76, in the toggle linkage are in a horizontal line thus extending the linkage to its maximum length and putting the linkage in a "dead center" position. Cylindrical protrusion 75 is now captivated in the straight portion 82 of the cam track in trigger slide 4. Additional rearward movement of trigger slide 4 will impart no additional motion to protrusion 75. Any forward force by barrel 5 will be counteracted by the toggle linkage acting against the inner frame 2 at pivot journal 73 and no forward force will be exerted on trigger slide 4.

The additional rearward motion of barrel 5 acting on magazine 18 has pushed magazine 18 back against rear wall 79 of the magazine channel in inner frame 2. Flat leaf spring 80 is now in its full compressed position. This puts magazine 18 and its associated cartridges within striking distance of firing pin 30 on hammer 9 (see FIG. 29).

Figure 28:
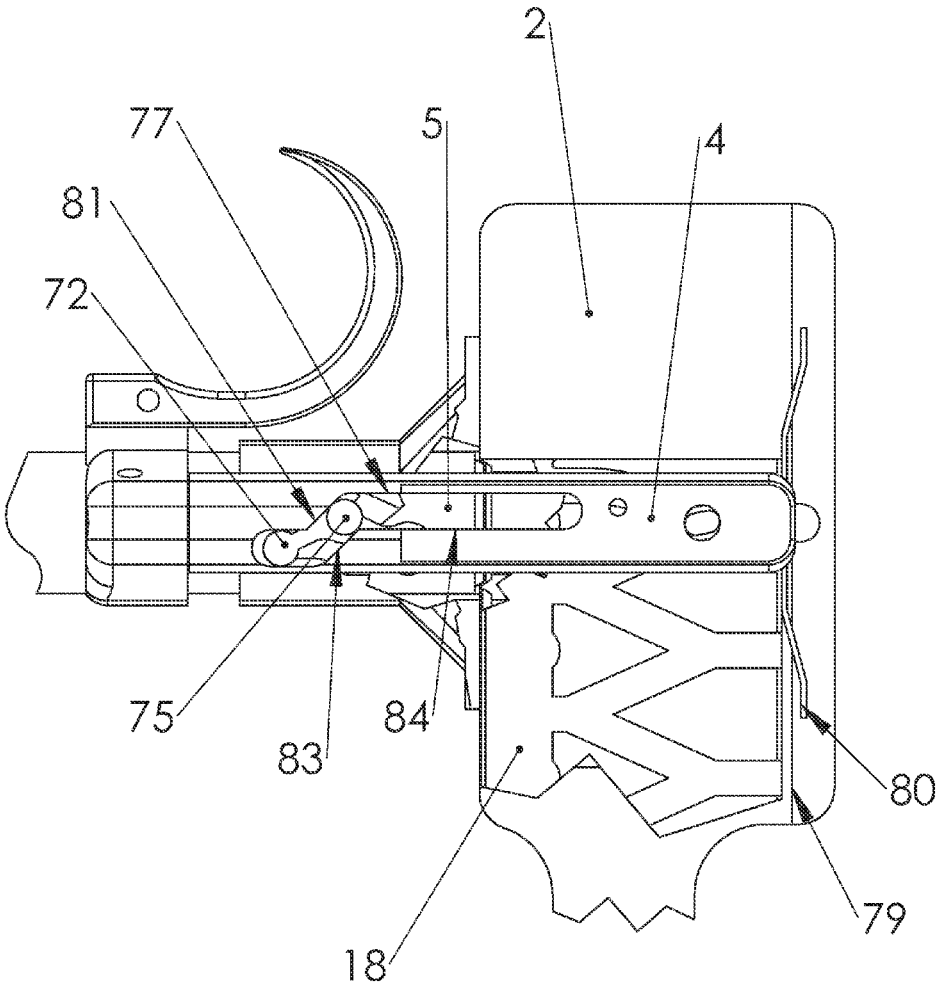
FIG. 28 is the same as FIG. 27 but with the trigger beginning its return stroke and showing the disengagement of the barrel and magazine.

FIG. 28 is the same assembly as illustrated in FIGS. 24 through 27 above but with trigger slide 4 beginning its return stroke after gun firing. The forward motion of trigger slide 4 has brought inclined cam surface 83 on trigger slide 4 in contact with toggle linkage protrusion 75 and has lived did protrusion 75 up and rotated toggle link 72 in a counterclockwise direction. This has shortened the effective length of toggle linkage 72-74 and has pulled barrel 5 forward. Magazine 18 has been moved forward under the force of flat leaf spring 80 and there is now a gap between magazine 18 and rear wall 79 of the magazine channel in inner frame 2. This gap will clear magazine 18 and its associated cartridges from firing pin 30 (see FIG. 29) and allow magazine 18 to index freely.

Figure 29:
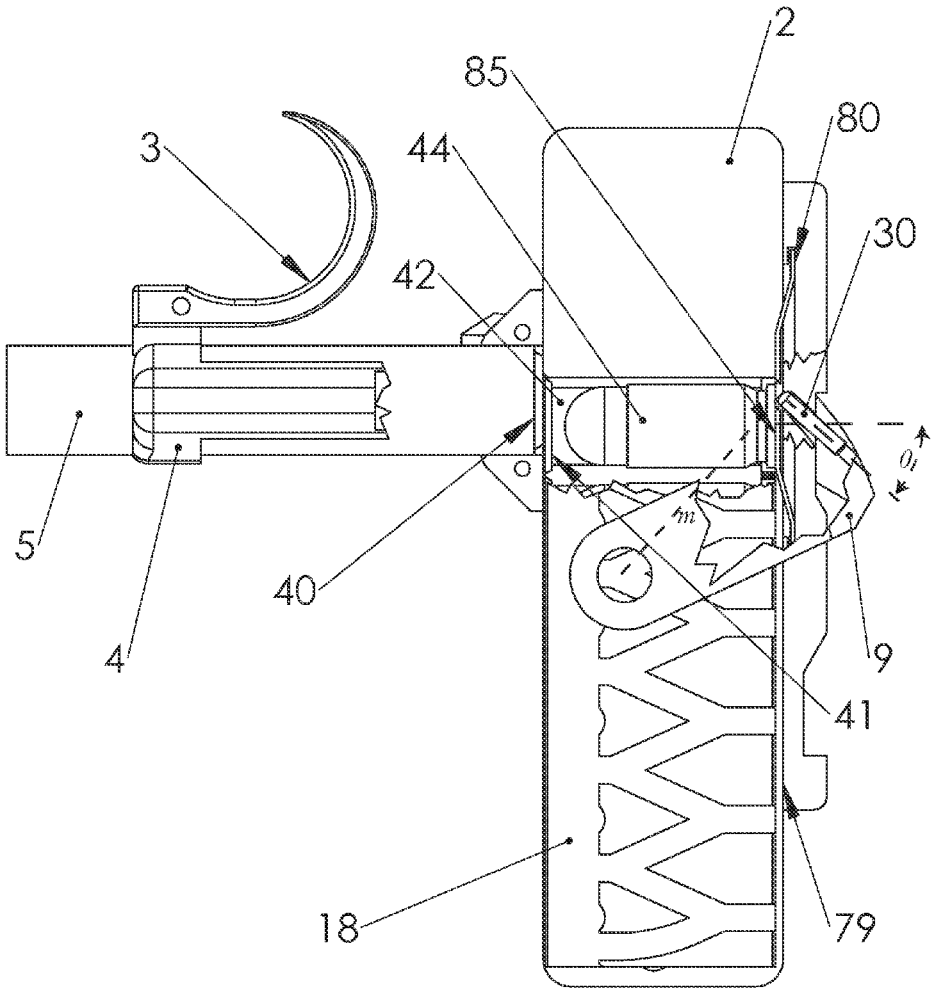
FIG. 29 is a partial assembly schematic drawing of a handgun in an "at rest" position illustrating how the movement of a magazine, utilizing the above barrel and magazine locating mechanisms, may also serve to provide clearance between a firing pin and a cartridge after the handgun is fired.

FIG. 29 is a side view cutaway assembly schematic drawing of one embodiment of a handgun according to this invention. FIGS. 29 through 32 better illustrate a system wherein the movement of magazine 18 coupled with the movement of barrel 5 combine to, not only align firing chambers 42 with barrel 5 but also serve as a firing pin relief system. This combined system can be incorporated into any of the alignment actuating mechanisms described above. In FIG. 29 the gun is in its "at rest" position with trigger slide 4 in its forward position and magazine 18 at its one half index position. Barrel 5 is in its forward position and conical pilot protrusion 40 is safely recessed into inner frame 2 out of the path of magazine 18. Magazine 18 is in its forward position and flat leaf spring 80 assures that there is a gap between magazine 18 and the back wall 79 of the magazine channel in inner frame 2. This gap is sufficient to keep the firing pin 30 on hammer 9 clear of magazine 18 and its associated cartridges 44. There may be small clearances between magazine 18 and both the front wall of the magazine channel and flat leaf spring 80 thus keeping magazine 18 free to index.

Figure 30:
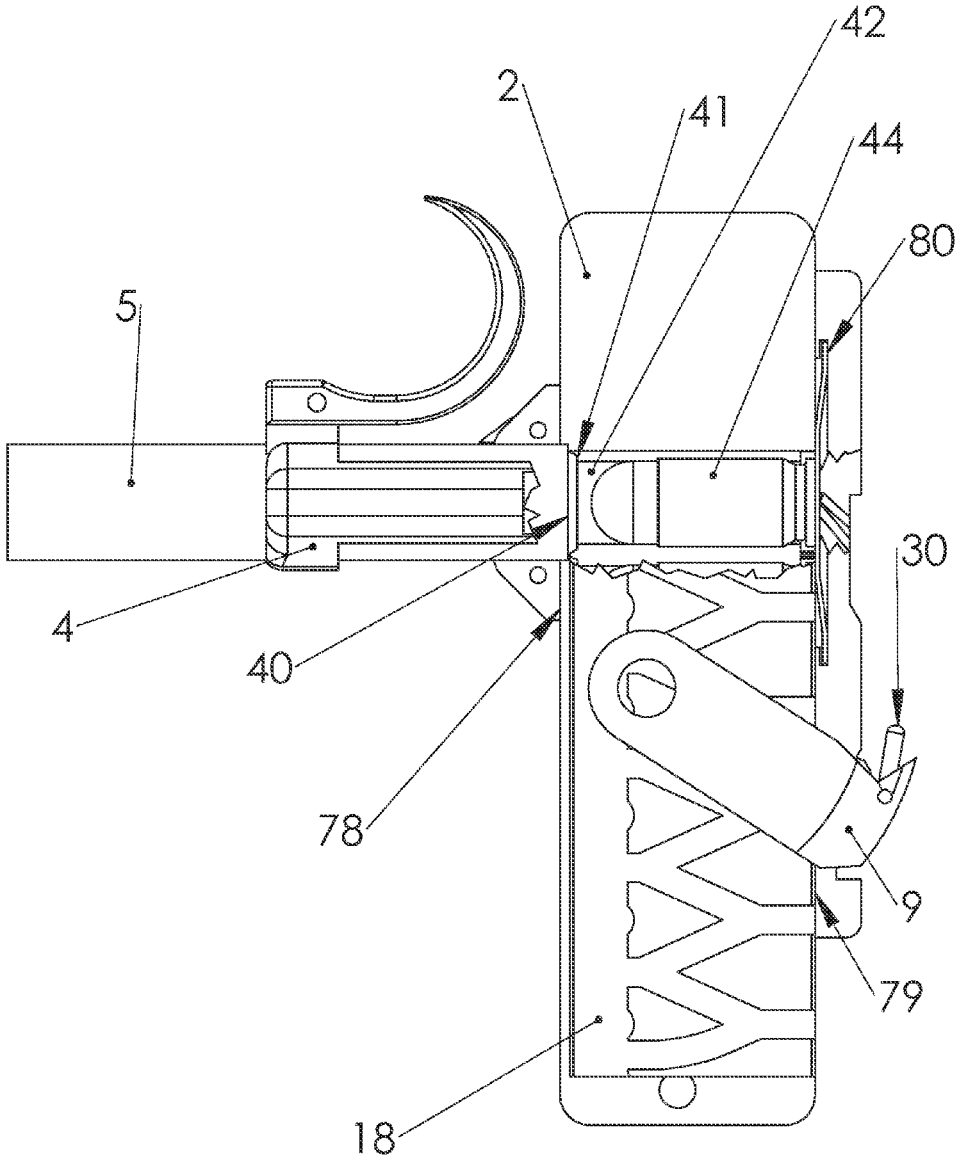
FIG. 30 is the same as FIG. 29 but with the handgun in a "just before firing" position.

FIG. 30 shows the same assembly as shown in FIG. 29 but with trigger slide 4 pulled back to just before trigger trip. Magazine 18 has been indexed up to the alignment position where firing chamber 42 is in line with barrel 5. Barrel 5 has been moved back by any one of the previously described mechanisms and conical pilot diameter 40 on barrel 5 is engaged in conical pilot counter bore 41 in firing chamber 42 of magazine 18. The rearward movement of barrel 5 has also moved magazine 18 back against rear wall 79. Cartridge 44 is now firmly against rear wall 79 and within striking distance of firing pin 30 on hammer 9.

Figure 31:
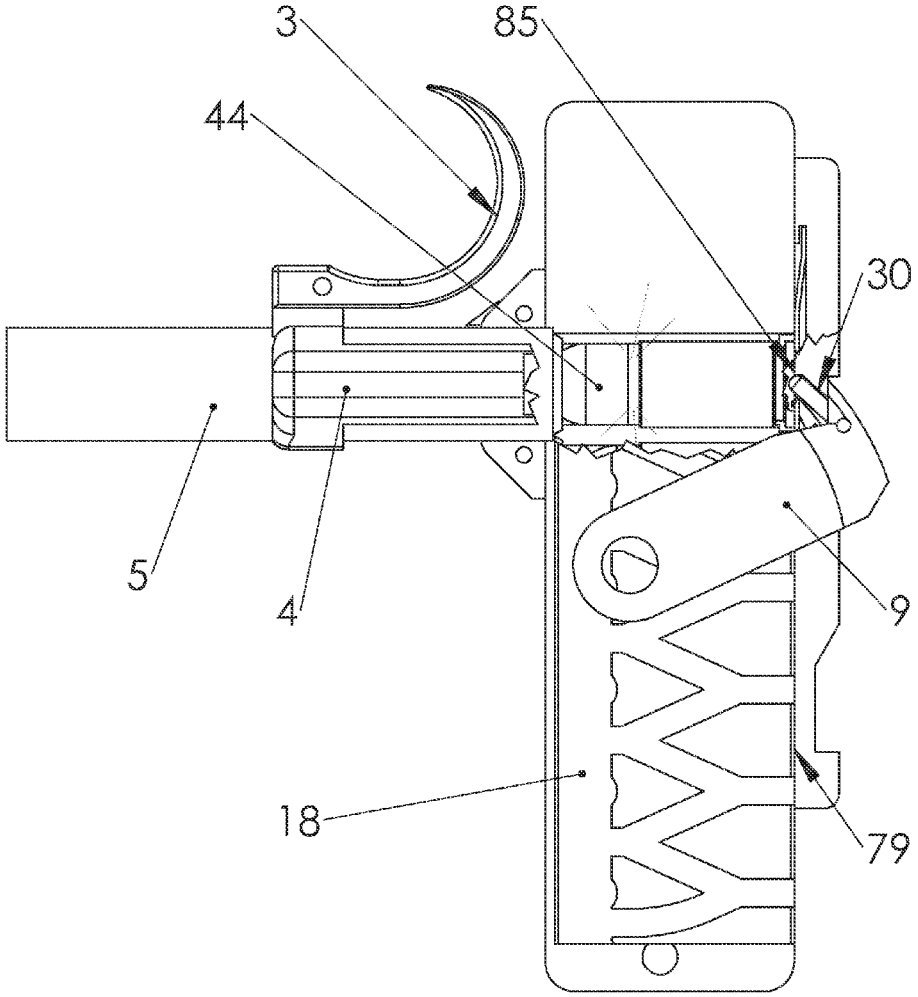
FIG. 31 is the same as FIGS. 29 and 30 above but with the handgun in a "just fired" position.

FIG. 31 shows the same assembly as shown in FIGS. 29 and 30 but with the gun in the just "fired position". Trigger slide 4 is in its full "pulled" position and magazine 18 is firmly against rear wall 79. Hammer 9 has swung forward and firing pin 30 has struck and exploded primer cap 85 thus firing cartridge 44.

Figure 32:
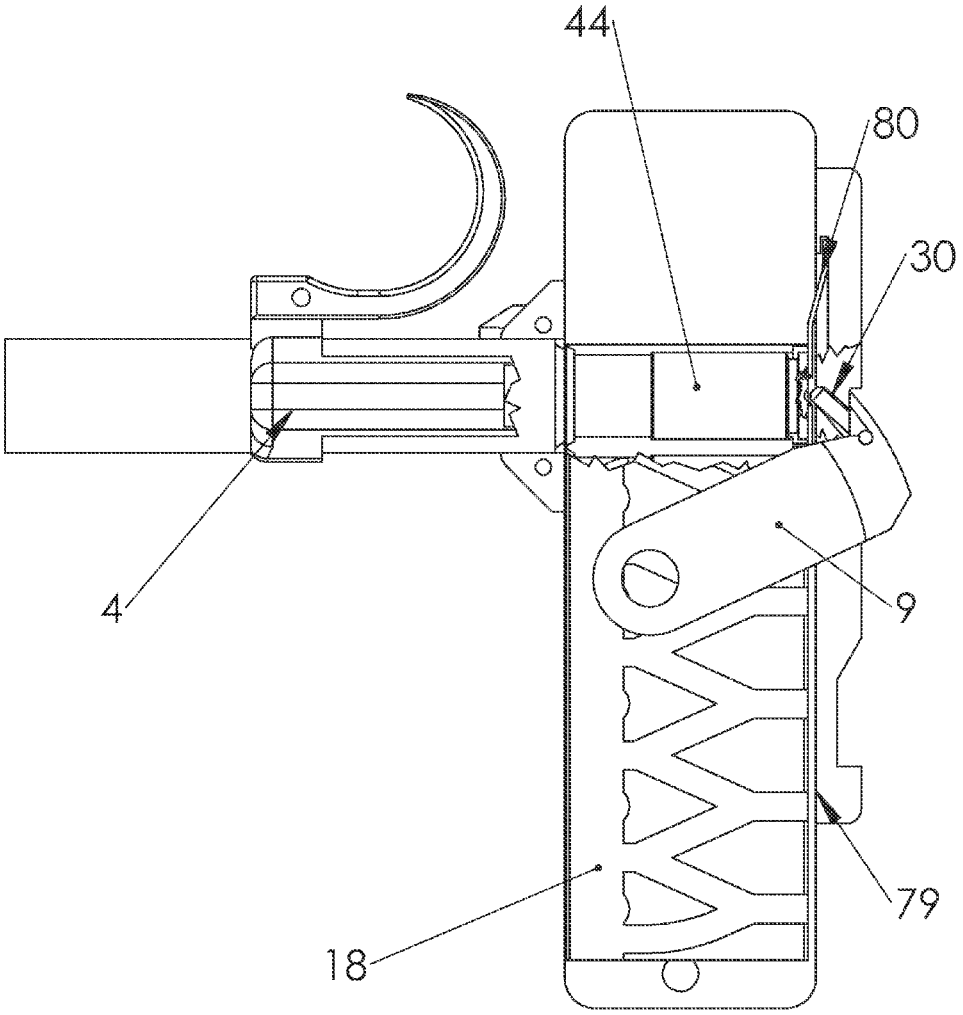
FIG. 32 is the same as FIGS. 29 through 31 above but with the trigger just beginning its return stroke and illustrating clearance between a firing pin and a spent cartridge.

FIG. 32 is the same assembly shown in FIGS. 29 through 31 above but in a position where the gun had just fired and the trigger is just starting its return stroke. Barrel 5 has moved forward and in magazine 18 has moved forward under the pressure of flat leaf spring 80. There is now a sufficient gap between the tip of firing pin 30 and the back surface of cartridge 44 and the rear face of magazine 18 to allow magazine 18 to index freely.

Figure 33:
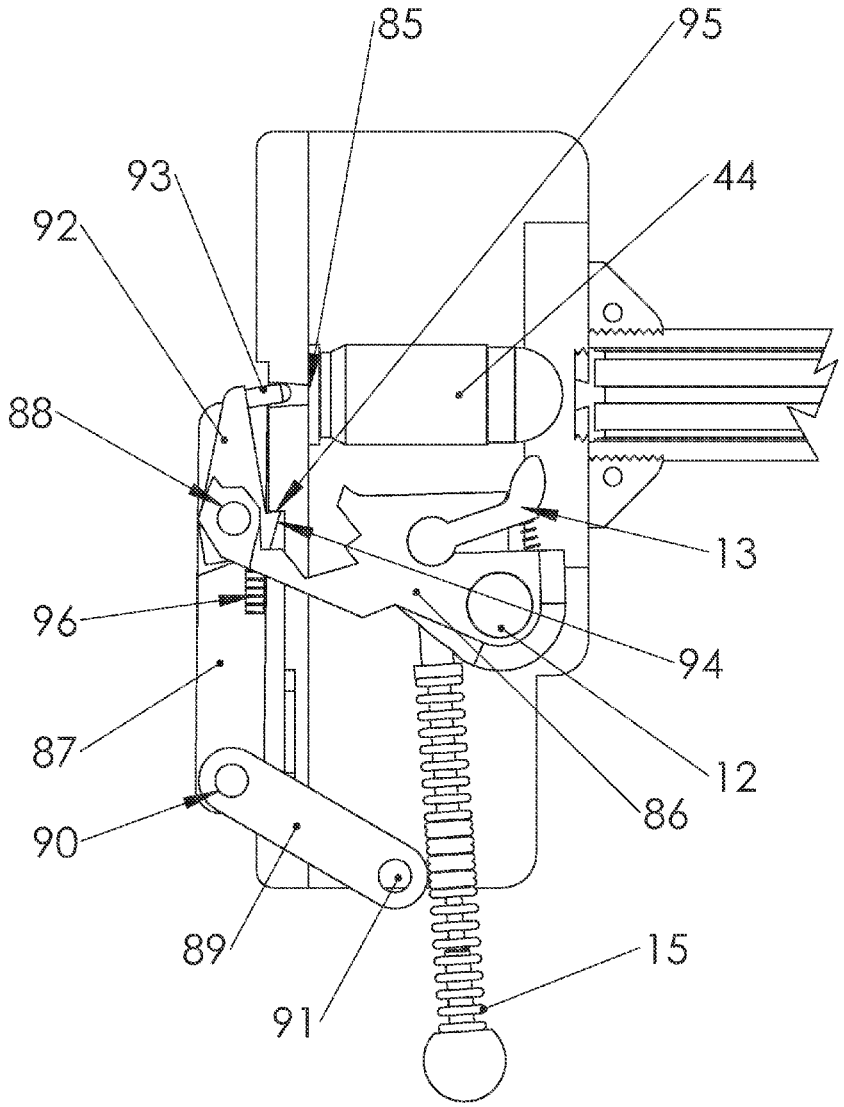
FIG. 33 is a free-floating subassembly drawing illustrating a combination and variation of the firing mechanisms previously described.

FIG. 33 is a free-floating partial assembly schematic drawing illustrating a combination and variation of firing mechanisms previously described. The center section of firing hammer 9 in FIG. 1 has been removed leaving to independent hammer driver levers, 86 on the near side of inner frame 2 and 97 on the far side of inner frame 2. Hammer driver lever 86 is rotatably journaled to inner frame 2 on pin 12. The opposite end of hammer driver lever 86 is rotatably journaled to a center hammer bar 87 at pin joint 88. Two idler links 89 are attached on each side of hammer bar 87 at pivot pin 90. The opposite ends of idler links 89 are rotatably journaled to inner frame 2 at pivot pin 91. The arrangement of inner frame 2, hammer driver levers 86, center hammer bar 87 and idler links 89 form a four bar linkage. Hammer driver lever 86 may be driven by trigger slide 4 (not shown here but shown in FIG. 1 above) by the horizontal motion of trigger slide 4 acting on sear 13. This motion will cause hammer driver lever 86 to rotate counterclockwise about pivot pin 12 and, in turn, to rotate the other connected linkages counterclockwise. Firing pin lever 92 may be mounted in a slot in the center of the center hammer bar 87 and rotatably attached by pin 88. 93 is a firing pin attached to lever 92. Finger 94 is integral with firing pin lever 92. Undercut surface 95 on inner frame 2 is positioned to engage finger 94 on firing pin lever 92. Spring 96 urges firing pin lever 92 in a counterclockwise direction. In FIG. 33, the firing mechanism is in its "at rest" position with hammer driver lever 86 forced in a clockwise position to clear firing pin 93 from cartridge primer cap 85 by hammer relief lever 10 (not shown here but shown in FIG. 1) or by any suitable means.

Figure 34:
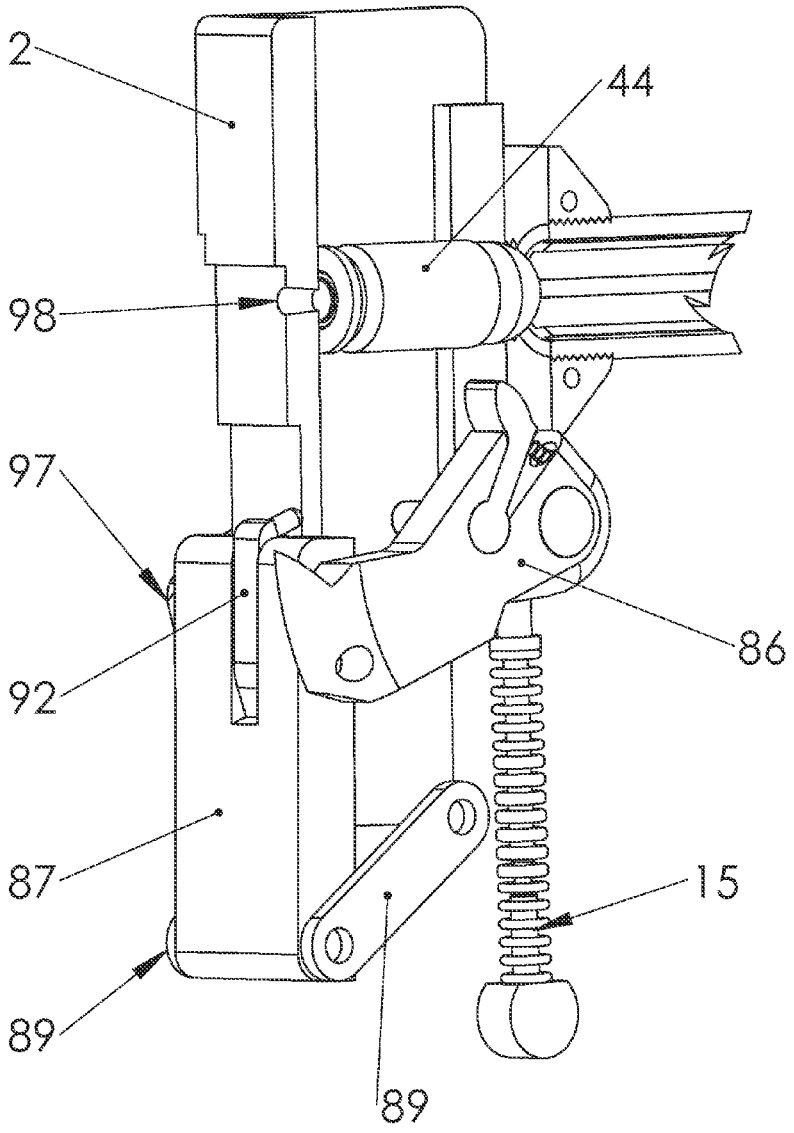
FIG. 34 is a free-floating isometric assembly schematic drawing of the firing mechanism shown in FIG. 33 but with the mechanism in its maximum cocked position.

FIG. 34 is an isometric partial assembly schematic drawing of the same mechanism as shown in FIG. 33 above. In FIG. 34, hammer driver lever 86 has been driven to its maximum counterclockwise rotated position by trigger slide 4 (not shown here but shown in FIG. 1 above). Sear 13 will slip off of trigger slide 4 at this point and hammer spring 15 will force hammer driver lever 86 and its connected linkages in a rapid clockwise motion.

Figure 35:
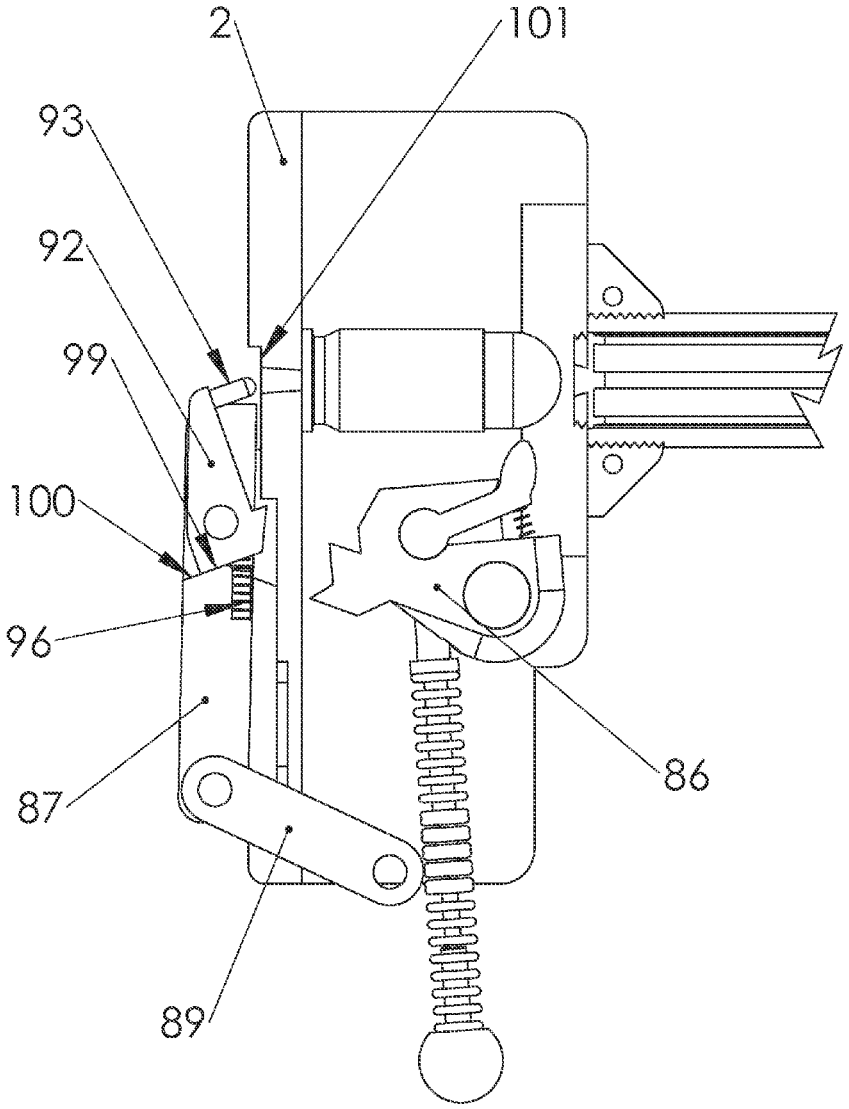
FIG. 35 is a free-floating schematic assembly drawing showing the firing mechanism illustrated in FIGS. 33 and 34 above with the mechanism past the midpoint of its firing stroke.

FIG. 35 shows the same firing mechanism as illustrated in FIGS. 33 and 34 above but with the firing mechanism past the midway point in its firing stroke. The four bar linkage has rotated clockwise and center hammer bar 87 is traveling on a nearly vertical path upward. Firing pin lever 92 is held in a stationary counterclockwise position by the pressure of spring 96 and the surface 99 on firing pin lever 92 engaging flat surface 100 on center hammer bar 87. Firing pin 93 is held clear of rear wall 101 of inner frame 2.

Figure 36:
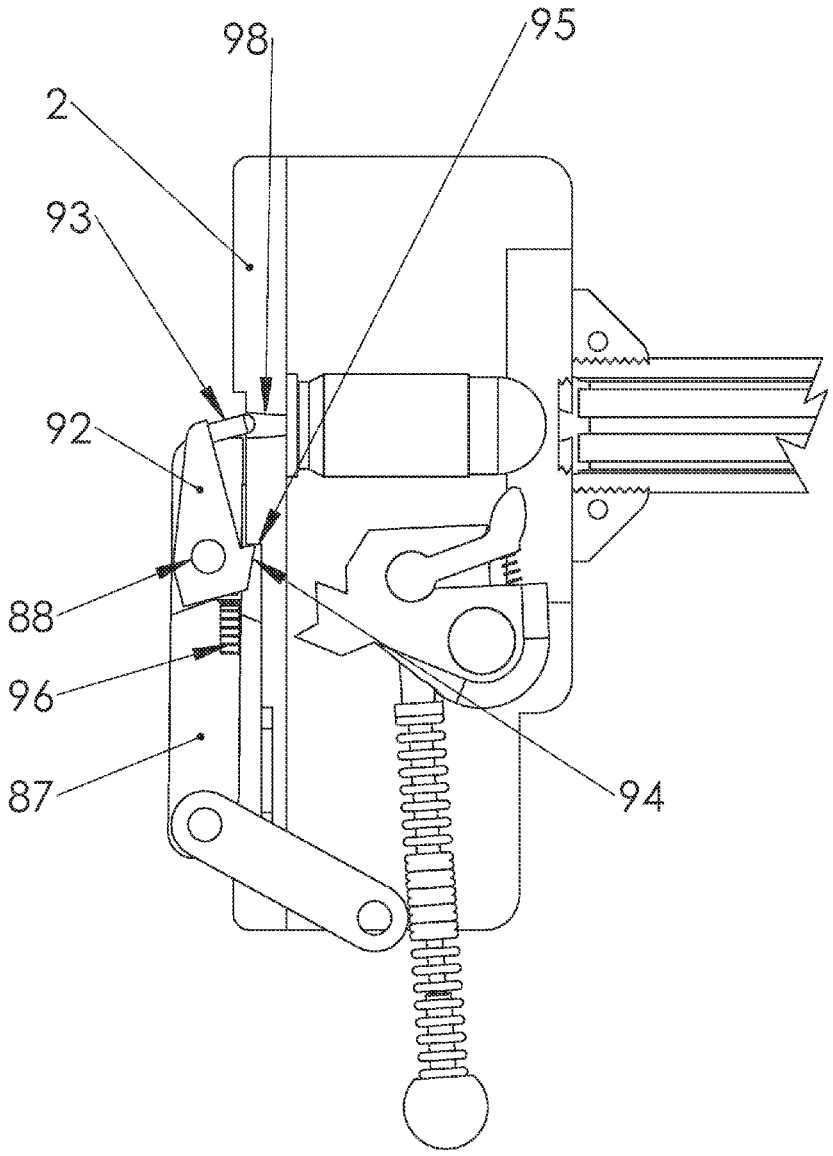
FIG. 36 is the same as FIG. 35 but with the firing pin lever halfway through its rotation.

FIG. 36 shows the same firing mechanism as illustrated in FIG. 35 above but with center hammer bar 87 in a further upward position. Finger 94 on firing pin lever 92 has engaged flat surface 95 on inner frame 2. The continued upward motion of center hammer link 87 has caused firing pin lever 92 to rotate clockwise about pin 88. Firing pin 93 is entering hole 98 in inner frame 2 which is in line with primer cap 85 on cartridge 44.

Figure 37:
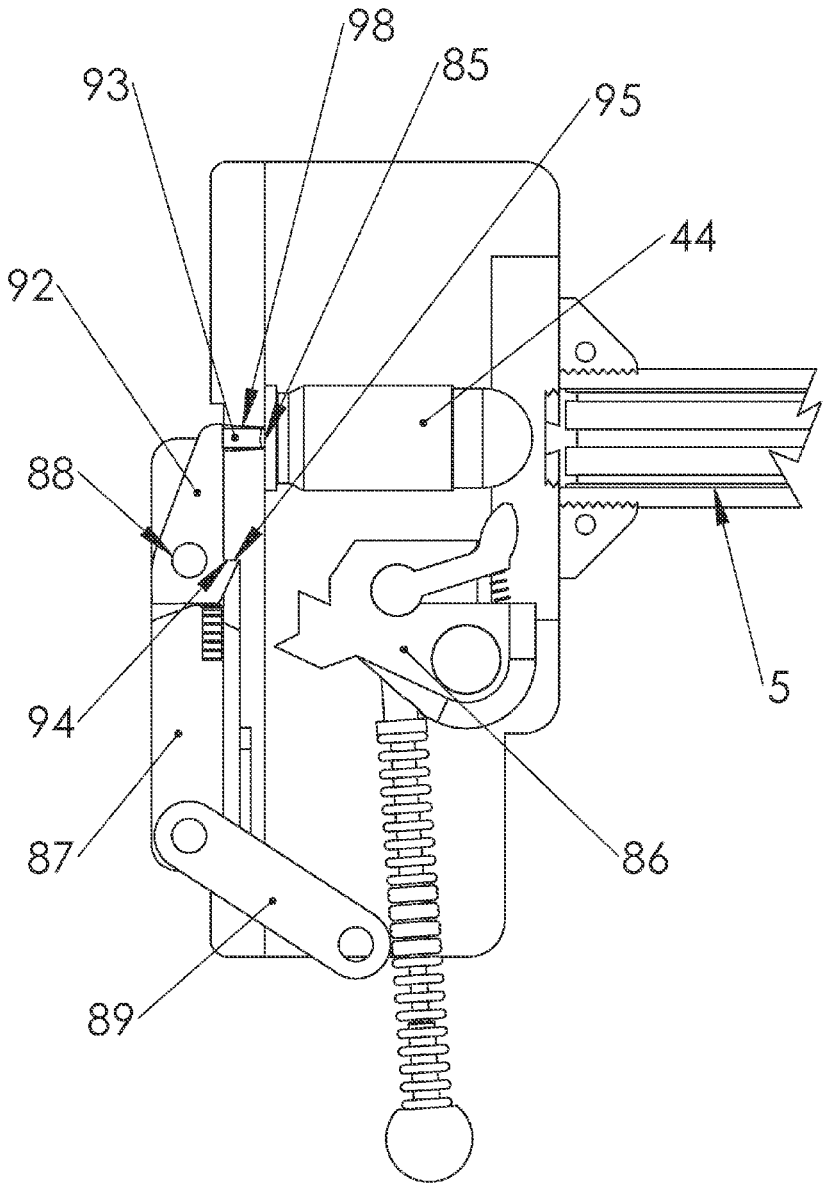
FIG. 37 is the same as FIG. 35 above but with the firing mechanism in its "just fired" position.

FIG. 37 shows the same firing mechanism as illustrated in FIG. 36 above but with the mechanism in its "just fired" position. Finger 94 of firing pin lever 92 is fully engaged with flat surface 95 on inner frame 2. The upward motion of center hammer bar 87 has caused firing pin lever 92 to rapidly rotate clockwise and drive firing pin 93 into primer cap 85 of cartridge 44 thus firing the cartridge. In FIG. 37, hammer driver link 86 has been driven by hammer spring 15 through to the full end of its stroke. As an alternative, the travel of hammer spring 15 could be restricted such that it disengages from hammer driver link 86 before firing pin 93 enters the magazine chamber and contacts primer cap 85. The inertia of the linkage would cause their motion to continue and fire cartridge 44. The mechanism would then be free to drop back and allow firing pin 93 to be clear of cartridge 44 and out of the magazine chamber. While in FIG. 37, center hammer bar 87 is mounted in and controlled by the four bar linkage, it could be mounted in a straight vertical track and be driven only by hammer driver link 86 similar to previous embodiments described in this invention. The purpose and benefit of the center hammer bar and four bar linkage is to provide much greater moving mass in a small space to create more energy to fire a cartridge. This additional moving mass plus the very quick motion of firing pin lever 92 may create very high impact with very low pressure required from hammer spring 15. This may create a much softer trigger pull.

To provide a compact design, in an exemplary embodiment, a firearm according to principles of the invention includes a hammer 9 that pivots from a pivot pin 12 located below the firing chamber between the leading edge and trailing edge of the firing chamber. The hammer 9 includes a body and an element (e.g., firing pin 30) that strikes a primer. The hammer body pivots less than 180 degrees. The firing pin 30 strikes the primer of a cartridge contained in the chamber. The struck primer ignites a propellant. Combustion gasses from the propellant propel a projectile of the cartridge from the chamber and through the barrel. In a particular embodiment, the hammer firing pin 30 strikes the primer at an acute angle (θ). The acute angle is measured between the longitudinal axis of the chamber and the longitudinal axis of the firing pin 30 (or an axis normal to the striking surface of the firing pin 30). The acute angle is 30 to 75 degrees, preferably 40 to 60 degrees and more preferably about 45 degrees.

The hammer body defines a moment arm (m) measured from the center of the pivot pin 12 to the striking surface of the firing pin 30. The moment arm is greater than the diameter of firing chamber, and preferably greater than 125 percent of the firing chamber, and more preferably greater than 150 percent of the diameter of the firing chamber. Such a moment arm generates sufficient torque for reliable firing, even if the range of pivoting motion of the hammer body is appreciably less than 180 degrees.

In another embodiment the exemplary firearm includes a trigger slide 4 with a pocket 50 (i.e., at least one pocket 50) cupping a ball bearing 7 (i.e., cupping a ball bearing in each pocket 50, to facilitate smooth sliding motion of the trigger. In such an embodiment the slide and bearing also stabilize the trigger.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. Unless expressly stated otherwise, numerical values are provided for exemplary non-limiting purposes, and may vary by ±20% of each stated value without departing from the scope of the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A handgun comprising a barrel;

a firing chamber for holding a cartridge; said cartridge including a projectile, a propellant and a primer, said propellant being between the projectile and primer; said firing chamber being aligned with the barrel and having a leading edge in communication with the barrel and an opposite trailing edge; said cartridge being contained in the firing chamber between the leading edge and the trailing edge with the primer adjacent to the trailing edge and the projectile adjacent to the leading edge;

a hammer including a body and a firing pin extending from the hammer body, said hammer body being pivotally mounted to a pivot pin located below the firing chamber between the leading edge and the trailing edge of the firing chamber, said hammer body pivoting about the pivot pin from an at rest position to a firing position, and in said firing position said firing pin striking the primer.

2. The handgun according to claim 1, said firing pin striking the primer at an acute angle when the hammer body is in the firing position, said acute angle comprising an angle measured between a longitudinal axis of the chamber and a longitudinal axis of the firing pin, said acute angle being greater than 0 degrees and less than 90 degrees.

3. The handgun according to claim 2, said acute angle comprising an angle of 30 to 75 degrees.

4. The handgun according to claim 2, said acute angle comprising an angle of 40 to 60 degrees.

5. The handgun according to claim 2, said acute angle comprising an angle of 45 degrees.

6. The handgun according to claim 2, said acute angle comprising an angle of about 45 degrees.

7. The handgun according to claim 2, said pivoting about the pivot pin from the at rest position to the firing position comprising less than 180 degrees of pivoting rotation.

8. The handgun according to claim 1, said hammer body defining a moment arm measured from a center of the pivot pin to a striking surface of the firing pin, said moment arm being greater than a diameter of firing chamber.

9. The handgun according to claim 8, said moment arm being greater than 125 percent of the diameter of the firing chamber.

10. The handgun according to claim 9, said moment arm being greater than 150 percent of the diameter of the firing chamber.

11. The handgun according to claim 2, said hammer body defining a moment arm measured from a center of the pivot pin to a striking surface of the firing pin, said moment arm being greater than a diameter of firing chamber.

12. The handgun according to claim 11, said moment arm being greater than 125 percent of the diameter firing chamber.

13. The handgun according to claim 12, said moment arm being greater than 150 percent of the firing chamber.

14. The handgun according to claim 1, said handgun further comprising a trigger assembly operably coupled to the hammer, said trigger assembly comprising a finger lever attached to a trigger slide.

15. The handgun according to claim 14, said trigger assembly further comprising a ball bearing and a pocket containing the ball bearing, said pocket being formed in the trigger slide.

16. The handgun according to claim 15, said pocket rotatably cupping the ball bearing, said ball bearing being rotatable within the pocket.

17. The handgun according to claim 2, said handgun further comprising a trigger assembly operably coupled to the hammer, said trigger assembly comprising a finger lever attached to a trigger slide.

18. The handgun according to claim 17, said trigger assembly further comprising a ball bearing and a pocket containing the ball bearing, said pocket being formed in the trigger slide.

19. The handgun according to claim 18, said pocket rotatably cupping the ball bearing, said ball bearing being rotatable within the pocket.

20. A handgun comprising a barrel;

a firing chamber for holding a cartridge; said cartridge including a projectile, a propellant and a primer, said propellant being between the projectile and primer; said firing chamber being aligned with the barrel and having a leading edge in communication with the barrel and an opposite trailing edge; said cartridge being contained in the firing chamber between the leading edge and the trailing edge with the primer adjacent to the trailing edge and the projectile adjacent to the leading edge;

a hammer including a body and a firing pin extending from the hammer body, said hammer body being pivotally mounted to a pivot pin, said hammer body pivoting about the pivot pin from an at rest position to a firing position, and in said firing position said firing pin striking the primer; and a trigger assembly operably coupled to the hammer, said trigger assembly comprising a finger lever attached to a trigger slide, a ball bearing and a pocket containing the ball bearing, said pocket being formed in the trigger slide, and said ball bearing being rotatable within the pocket.

* * * * *